US006351239B1

(12) United States Patent
Mizuno et al.

(10) Patent No.: US 6,351,239 B1
(45) Date of Patent: Feb. 26, 2002

(54) ELECTRONIC DEVICE IN WHICH INTEGRATED ANTENNA AND FILTER BOTH HAVE BALANCED TERMINALS

(75) Inventors: Kazuyuki Mizuno, Tokoname; Takami Hirai, Aichi-pref.; Yasuhiko Mizutani, Komaki; Hiroyuki Arai, 615-11, Imajukuhigashi-cho Asahi-ku, Yokohama-city, Kanagawa-pref. 241-0032, all of (JP)

(73) Assignees: NGK Insulators, Ltd., Nagoya; Hiroyuki Arai, Yokohama, both of (JP)

( * ) Notice: Subject to any disclaimer, the term of this patent is extended or adjusted under 35 U.S.C. 154(b) by 0 days.

(21) Appl. No.: 09/572,033

(22) Filed: May 16, 2000

(30) Foreign Application Priority Data

Feb. 3, 2000 (JP) ..... 12-026845

(51) Int. Cl.[7] ..... H01Q 1/36
(52) U.S. Cl. ..... 343/700 MS; 343/909; 343/795
(58) Field of Search ..... 343/700 MS, 850, 343/795, 756, 909, 741, 866, 806

(56) References Cited

U.S. PATENT DOCUMENTS

| | | | | |
|---|---|---|---|---|
| 4,607,394 A | | 8/1986 | Nightiingale | |
| 5,021,799 A | | 6/1991 | Kobus et al. | |
| 5,202,752 A | | 4/1993 | Honjo | |
| 5,684,492 A | * | 11/1997 | Kogoshima et al. . | 343/700 MS |
| 5,861,854 A | * | 1/1999 | Kawahata et al. ... | 343/700 MS |
| 5,867,126 A | * | 2/1999 | Kawahata et al. ... | 343/700 MS |
| 5,898,403 A | | 4/1999 | Saitoh et al. | |
| 5,912,646 A | * | 6/1999 | Seki et al. ..... | 343/700 MS |
| 5,959,582 A | * | 9/1999 | Kawahata et al. ... | 343/700 MS |

FOREIGN PATENT DOCUMENTS

| | | |
|---|---|---|
| DE | 689 20 317 | 12/1994 |
| EP | 0 409 867 | 1/1991 |
| EP | 0 858 126 | 8/1998 |
| JP | 9-162633 | 6/1997 |
| JP | 10-32413 | 2/1998 |
| JP | 10-41722 | 2/1998 |

OTHER PUBLICATIONS

Endo, Tsutomu, et al., "Resonant Frequency and Radiation Efficiency of Meander Line Antennas", Electronics and communications in Japan, Part 2, vol. 83, No. 1, 2000, pp. 52–58.

Parfitt, A.J., et al., "Analysis of Infinite Arrays of Substrate –Supported Metal Strip Antennas, " IEEE Transactions on Antennas and Propagation, vol. 41, No. 2, Feb. 1993, pp. 191 to 199.

* cited by examiner

*Primary Examiner*—Tan Ho
(74) *Attorney, Agent, or Firm*—Burr & Brown

(57) ABSTRACT

An antenna device is provided with a dielectric substrate comprising a large number of stacked dielectric layers and having at least an input/output terminal and a ground electrode formed on its outer circumferential surface. A plurality of ½ wavelength resonator elements of the both ends-open type are arranged in parallel to one another in the dielectric substrate respectively to construct a filter section. An antenna section is formed and constructed on the surface of the dielectric substrate. Two input/output electrodes are formed in the dielectric substrate, which are arranged at positions of point symmetry with respect to a center in the length direction of at least the resonator element disposed on the output side, of the plurality of ½ wavelength resonator elements. The two input/output electrodes are connected to balanced input/output terminals of the antenna section respectively.

13 Claims, 26 Drawing Sheets

ELECTRONIC DEVICE IN WHICH INTEGRATED ANTENNA AND FILTER BOTH HAVE BALANCED TERMINALS

BACKGROUND OF THE INVENTION

1. Field of the Invention

The present invention relates to an antenna device based on the balanced input system, including, for example, a dipole antenna and a loop antenna.

2. Description of the Related Art

In general, the basic antenna elements include, for example, a dipole antenna and a loop antenna based on the balanced input and a monopole antenna and a helical antenna based on the unbalanced input.

The antenna device based on the balanced input has a structure in which no ground plate is utilized and excitation is effected by the antenna device itself. The antenna device based on the unbalanced input has a structure in which excitation is effected by utilizing a ground plate.

When the antenna device based on the unbalanced input is mounted on a mobile communication instrument, the casing of the communication instrument functions as a ground plate. The ground plate is not an infinite plane. Therefore, an inconvenience arises in that it is necessary to adjust the antenna depending on the shape and the size of the casing.

On the other hand, the antenna device based on the balanced input is scarcely affected by the casing. The antenna device based on the balanced input is advantageous in that the adjustment is less laborious as compared with the antenna device based on the unbalanced input. As for the performance, the antenna device based on the balanced input is advantageous in gain and band width, because the antenna device itself is large as compared with the antenna device based on the unbalanced input.

A large number of suggestions have been hitherto made in order to realize a small size of an antenna device and realize a small size of a communication instrument, including, for example, those having an antenna pattern based on an electrode film formed on a surface of a dielectric substrate (for example, see Japanese Laid-Open Patent Publication Nos. 10-41722, 9-162633, and 10-32413).

The antenna device based on the unbalanced input has been hitherto used as an antenna device for the high frequency zone, because of the following reason.

That is, a 1st stage filter, which is connected to the antenna device, is based on the unbalanced output. Therefore, when the antenna device based on the balanced input is connected to the filter based on the unbalanced output, it is necessary to use a balun as a balanced-unbalanced converter.

When the balun is provided, then the number of parts is increased, and the areal size occupied by the substrate is increased. As a result, a problem arises in that it is impossible to realize a small size of the antenna device which is the basic request.

In other words, in the present circumstances, it is advantageous to use an antenna device based on the unbalanced input in view of the insertion loss and the cost.

However, it is clear that if the antenna device based on the balanced input can be connected to the filter without using the balun, then it is possible to sufficiently exhibit the advantages possessed by the antenna device based on the balanced input, and it is possible to further facilitate the realization of a small size and high performance of the antenna device.

SUMMARY OF THE INVENTION

The present invention has been made taking the foregoing problems into consideration, an object of which is to provide an antenna device which makes it possible to appropriately select and perform a balanced input (output) and an unbalanced input (output) for the connection between a filter and an antenna, and which makes it possible to realize a small size and high performance of electronic instruments (including communication instruments) provided with the antenna.

According to the present invention, there is provided an antenna device comprising an antenna section which is based on a balanced input/output; and a filter section in which at least an input/output portion connected to the antenna section is based on the balanced input/output.

That is, the input/output system of the filter section on the side of the antenna section is the balanced input/output system. Therefore, it is possible to provide the antenna device wherein the antenna section, which is connected to the input/output terminal of the filter section, is based on the balanced input system.

As described above, in the antenna device according to the present invention, the balanced input (output) and the unbalanced input (output) can be appropriately selected and performed for the connection between the filter section and the antenna section. Thus, it is possible to realize a small size and high performance of the electronic instrument (including the communication instrument) having the antenna section.

In the antenna device constructed as described above, it is also preferable that the device further comprises a ground electrode for constructing a capacitance together with an open end of the antenna section. In this arrangement, the capacitance, which is formed between the open end of the antenna section and the ground electrode, is added to the capacitance of the parallel resonance circuit obtained by the equivalent transformation of the antenna section. Therefore, assuming that the resonance frequency is identical, it is enough that the parallel resonance circuit has a small inductance. As a result, it is possible to further decrease the length of the antenna section (antenna length). Thus, it is possible to shorten the length of the entire antenna section.

That is, the input/output of the filter section on the side of the antenna section is the balanced input/output. Therefore, it is possible to provide an antenna device wherein the antenna section, which is connected to the input/output terminal of the filter section, is based on the balanced input.

In the antenna device constructed as described above, it is also preferable that the device is composed of a dielectric substrate which includes a large number of stacked dielectric layers and which has at least an input/output terminal and a ground electrode formed on its outer circumferential surface; wherein the filter section includes a plurality of ½ wavelength resonator elements of a both ends-open type arranged in parallel to one another in the dielectric substrate respectively; and the antenna section is formed on the dielectric substrate.

In this arrangement, the antenna section may be formed on a surface of the dielectric substrate, or it may be formed at the inside of the dielectric substrate. Alternatively, the antenna section and the filter section may be formed in regions which are two-dimensionally separated from each other on the dielectric substrate.

The ½ wavelength resonator, which is used for the filter section as one of the constitutive elements of the antenna device according to the present invention, has such a form that both ends are open. Therefore, it is unnecessary to form the resonator so that it extends up to the end of the dielectric substrate. The resonance frequency is not dispersed depending on, for example, any variation in substrate size caused during the production process. Therefore, it is possible to provide a high performance antenna device.

In the antenna device constructed as described above, it is also preferable that two input/output electrodes, which are arranged at positions of linear symmetry with respect to a center in a length direction of at least the ½ wavelength resonator disposed on an output side of the plurality of ½ wavelength resonators, are provided in the dielectric substrate; and the two input/output electrodes are connected to balanced input/output terminals of the antenna section.

That is, the filter section can appropriately select and perform the balanced input (output) and the unbalanced input (output) for the connection with the antenna section. Therefore, it is possible to use an antenna based on the balanced input/output system for the antenna section.

As described above, the filter section, which is one of the constitutive elements of the antenna device according to the present invention, makes it possible to obtain the balanced output by obtaining the outputs from the two electrodes disposed at symmetric positions with respect to the middle point of the ½ wavelength resonator. On the other hand, when antiphase signals are input at the symmetric positions with respect to the middle point of the ½ wavelength resonator, it is possible to cause the resonance. Accordingly, it is possible to perform the balanced input.

In the conventional technique, in order to connect the filter with the antenna element based on the balanced input/output system, it has been necessary to add the balun therebetween. On the contrary, in the present invention, the balanced input (output) and the unbalanced input (output) can be appropriately selected and performed for the connection with the antenna element. Therefore, it is possible to make the connection with the antenna section based on the balanced input/output system without using any excessive circuit part such as the balun. This contributes to the realization of the small size and the high performance of the antenna device.

In the antenna device constructed as described above, it is also preferable that the two input/output electrodes are capacitively coupled to the ½ wavelength resonator disposed on the side of the antenna section respectively. Alternatively, it is also preferable that the two input/output electrodes are directly connected to the ½ wavelength resonator disposed on the side of the antenna section respectively.

It is also preferable for the antenna device constructed as described above that the filter section includes a coupling-adjusting electrode which is overlapped with the adjoining ½ wavelength resonators with the dielectric layer interposed therebetween in the dielectric substrate and which effects capacitive coupling for the adjoining ½ wavelength resonators.

Accordingly, the capacitances are formed between the coupling-adjusting electrode and the ½ wavelength resonator and between the coupling-adjusting electrode and another ½ wavelength resonator respectively. The equivalent circuit has such a form that a combined capacitance of these capacitances is connected in parallel to the inductive coupling formed between the adjoining ½ wavelength resonators. Therefore, it is possible to adjust the degree of the coupling by means of the capacitance. Thus, it is possible to obtain the filter having a desired band width.

The capacitance can be easily adjusted by changing the overlapped areal size between the ½ wavelength resonator and the coupling-adjusting electrode, the distance therebetween, and/or the permittivity $\epsilon r$ of the dielectric disposed therebetween.

Equivalently, the combined capacitance based on the coupling-adjusting electrode is connected in parallel to the inductive coupling between the ½ wavelength resonators. Therefore, the parallel resonance circuit is consequently inserted and connected between the adjoining ½ wavelength resonators. The impedance of the parallel resonance circuit composed of the capacitance and the inductance is changed from the inductive to the capacitive at lower and higher than the parallel resonant frequency. Accordingly, the coupling between the ½ wavelength resonators can be made either inductive or capacitive by adjusting the value of the capacitance formed between the adjoining ½ wavelength resonators and the coupling-adjusting electrode respectively.

It is now assumed that the coupling between the ½ wavelength resonators is inductive. The parallel resonance point exists on the high frequency side of the pass band. Therefore, it is possible to obtain a filter which has the attenuation pole on the high frequency side. On the other hand, when the coupling between the ½ wavelength resonators is capacitive, the parallel resonance point exists on the low frequency side of the pass band. Therefore, it is possible to obtain a filter which has the attenuation pole on the low frequency side. In any case, it is possible to improve the attenuation characteristic of the filter.

In the antenna device constructed as described above, it is also preferable that a plurality of coupling-adjusting electrodes as defined above are formed; and the plurality of coupling-adjusting electrodes are formed at positions of linear symmetry with respect to a center in a length direction of the ½ wavelength resonator.

In this arrangement, it is possible to suppress the influence of the positional discrepancy between the ½ wavelength resonator and the coupling-adjusting electrode during the production steps. Specifically, the effect of the coupling-adjusting electrode is affected by the relative position with respect to the ½ wavelength resonator. However, when the coupling-adjusting electrodes are formed at the positions of linear symmetry with respect to the center in the length direction of the ½ wavelength resonator, the variations of effects of the plurality of coupling-adjusting electrodes are offset with each other, even if the positional discrepancy occurs in the longitudinal direction of the ½ wavelength resonator. Thus, it is possible to suppress the influence of the positional discrepancy between the ½ wavelength resonator and the coupling-adjusting electrode.

In the antenna device constructed as described above, it is also preferable that the filter section includes inner layer ground electrodes which are arranged to overlap both open ends of each of the ½ wavelength resonators with the dielectric layer interposed therebetween.

In this arrangement, the capacitance, which is formed between the inner layer ground electrode and the open end side of each of the ½ wavelength resonators, is also added to the capacitance of the parallel resonance circuit obtained by the equivalent transformation of the ½ wavelength resonator. Therefore, assuming that the resonance frequency is identical, it is enough that the inductance of the parallel resonance circuit is small. As a result, it is possible to further decrease the length of the ½ wavelength resonator (resonator length). Thus, it is possible to shorten the length of the entire filter section.

In this case, the following problem may arise. That is, when the opposing areal size of the inner layer ground electrode and each of the ½ wavelength resonators is increased in order to realize a small size of the filter section, the inductive coupling between the ½ wavelength resonators becomes stronger, resulting in a band width that is too broad. However, in the present invention, the coupling-adjusting electrode is provided as described above. Therefore, owing to the capacitance formed between the coupling-adjusting electrode and the ½ wavelength resonator, the absolute value of the total susceptance, which is formed by the capacitance between the ½ wavelength resonators and the inductive coupling between the ½ wavelength resonators, is changed. Therefore, the degree of the coupling between the ½ wavelength resonators can be adjusted by adjusting the value of the capacitance. Thus, it is possible to obtain the filter having a desired band width.

Even when any stacking discrepancy occurs in the longitudinal direction (axial direction) of the ½ wavelength resonator concerning the ½ wavelength resonator and the inner layer ground electrode, it is possible to decrease the dispersion of the resonance frequency, because the changes in capacitance at the respective open ends of the ½ wavelength resonators are offset with each other.

In the antenna device constructed as described above, it is also preferable that the dielectric substrate is formed such that a dielectric constant of the dielectric layer on which the antenna section is formed is different from a dielectric constant of the dielectric layer on which the filter section is formed. Especially, when the dielectric constant of the dielectric layer on which the antenna section is formed is lower than the dielectric constant of the dielectric layer on which the filter section is formed, it is possible to realize the small size of the filter section. Simultaneously, it is possible to effectively suppress the low gain and the decrease in band width in the antenna section.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENTS

Several illustrative embodiments of the antenna device according to the present invention will be explained below with reference to FIGS. 1 to 26. For convenience of explanation, the following assumptions are made in connection with the drawings: the leftward surface is referred to as the left side surface, the rightward surface is referred to as the right side surface, the forward surface is referred to as the front surface, and the backward surface is referred to as the back surface.

Figure 1:
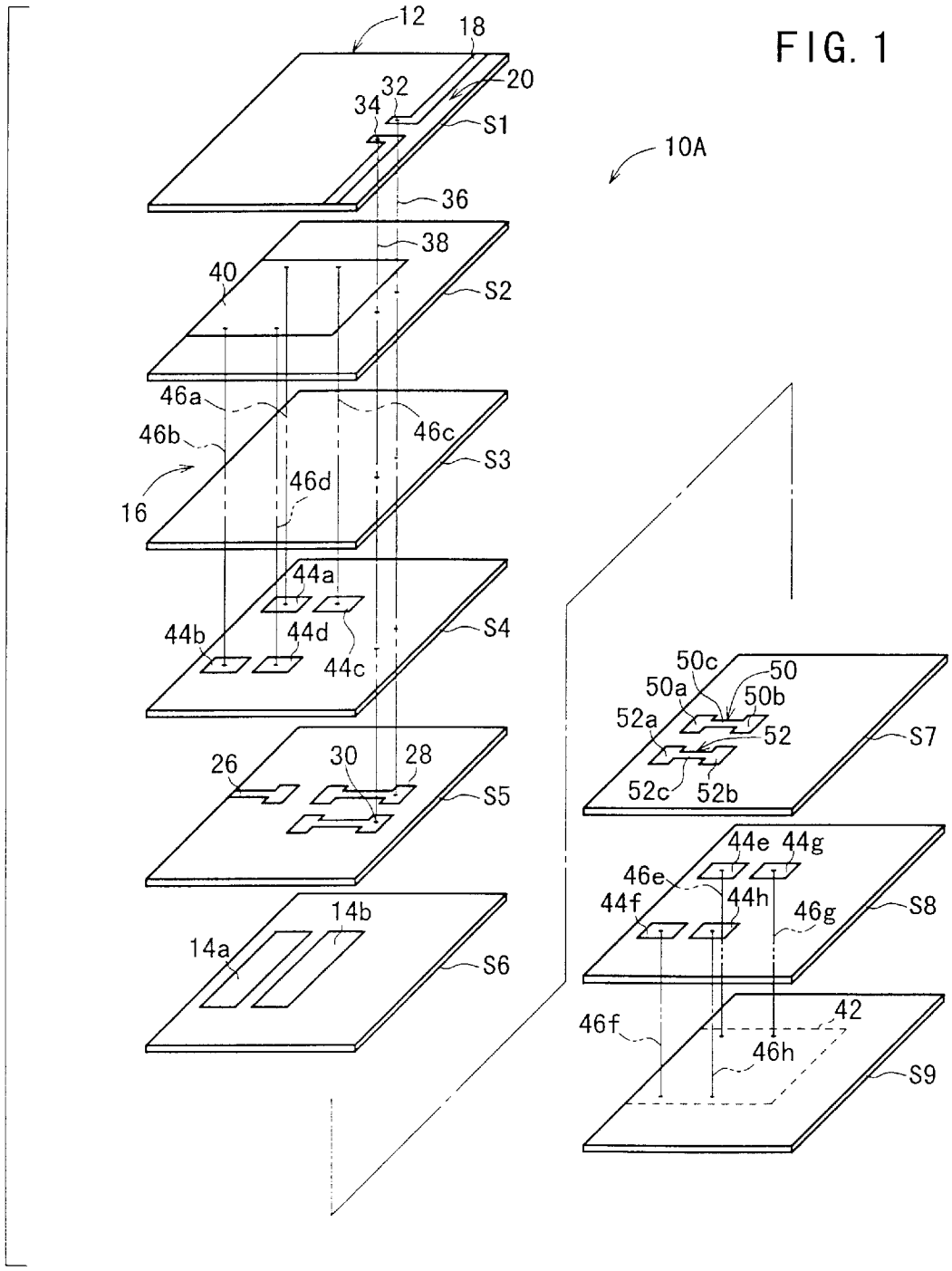
FIG. 1 shows an exploded perspective view illustrating an arrangement of an antenna device according to a first embodiment.

As shown in FIG. 1, an antenna device 10A according to a first embodiment comprises a filter section 16 and an antenna section 20 disposed in a dielectric substrate 12 formed by stacking and sintering a plurality of plate-shaped dielectric layers. The filter section 16 includes two ½ wavelength resonator elements 14*a*, 14*b* of the both ends-open type which are formed in parallel to one another. The antenna section 20 includes a dipole antenna 18 which is formed by electrode films on the upper surface of the dielectric substrate 12. In this arrangement, the antennas 18 for constructing the antenna section 20 are formed on the first dielectric layer S1 so that respective open ends are disposed at mutually separated positions.

Specifically, as shown in FIG. 1, the dielectric substrate 12 comprises the first dielectric layer S1 to the ninth dielectric layer S9 which are stacked and superimposed in this order from the top. Each of the first to ninth dielectric layers S1 to S9 is composed of one layer or a plurality of layers.

The antenna section 20 and the filter section 16 are formed in regions which are separated from each other as viewed in a plan view. For example, with reference to FIG. 1, the filter section 16 is formed in the left region, and the antenna section 20 is formed in the right region. The antenna section 20 is formed on the upper surface of the first dielectric layer S1. The filter section 16 is formed over a range from the second dielectric layer S2 to the ninth dielectric layer S9.

Figure 3:
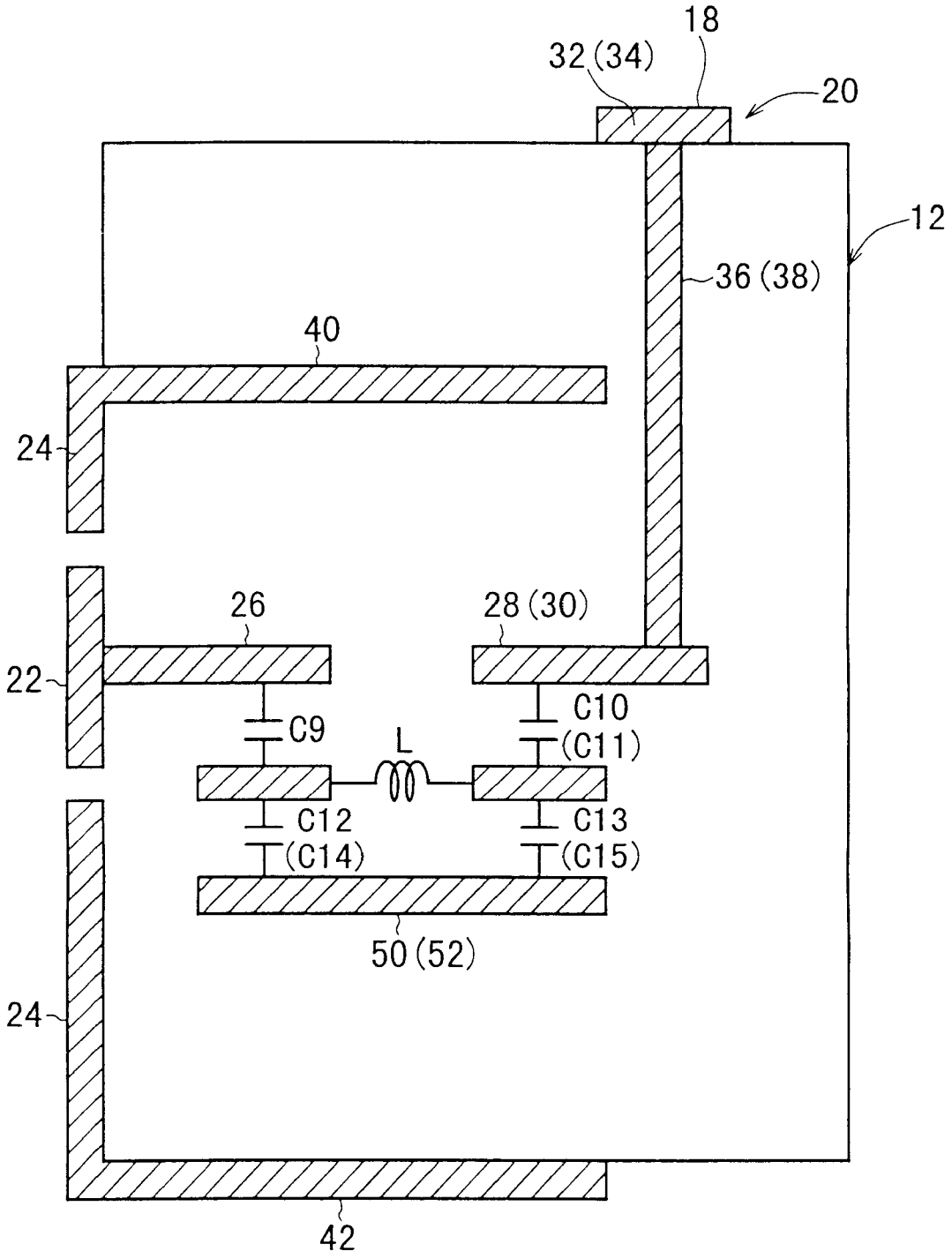
FIG. 3 shows a sectional view illustrating an arrangement obtained by cutting the antenna device according to the first embodiment in a direction perpendicular to a plane on which first and second input/output terminals are formed.

As shown in FIG. 3, one input/output terminal 22 is formed, for example, on the left side surface of the outer circumferential surface of the dielectric substrate 12. A ground electrode 24 is formed on a portion ranging from the left side surface to the lower surface except for the input/output terminal 22.

As shown in FIG. 1, the filter section 16 of the antenna device 10A according to the first embodiment comprises two resonator elements (first and second resonator elements 14*a*, 14*b*) which are formed in parallel to one another on the first principal surface of the sixth dielectric layer S6. Respective both ends of the resonator elements 14*a*, 14*b* are open.

One input/output electrode 26 and two input/output electrodes (first and second input/output electrodes 28, 30) are formed on the first principal surface of the fifth dielectric layer S5 disposed over the sixth dielectric layer S6 described above.

The input/output electrode 26 is formed to have its first end which is connected to the input/output terminal 22 (see FIG. 2), and it is capacitively coupled to the first resonator element 14*a*. The first and second input/output electrodes 28, 30 are formed to have their respective first ends which are connected to two balanced input/output terminals (first and second input/output terminals 32, 34) of the dipole antenna 18 via through-holes 36, 38 respectively, and they are capacitively coupled to the second resonator element 14*b*.

That is, the filter section 16 is electrically connected to the antenna section 20 directly in accordance with the balanced input/output without using any additional circuit part such as the balun. The filter section 16 is connected to another circuit (unillustrated) in accordance with the unbalanced input/output by the aid of the input/output electrode 26 disposed on the opposite side.

On the other hand, inner layer ground electrodes 40, 42 each having a rectangular configuration with a relatively large areal size, which extend from the left side surface of the dielectric substrate 12 respectively, are formed on the first principal surface of the second dielectric layer S2 and on the second principal surface of the ninth dielectric layer S9 (lower surface of the dielectric substrate 12) respectively.

Respective four inner layer ground electrodes corresponding to the respective both ends of the two resonator elements 14*a*, 14*b* described above, i.e., eight in total of the inner layer ground electrodes (first to eighth inner layer ground electrodes) 44*a* to 44*h* are formed on the first principal surface of the fourth dielectric layer S4 and on the first principal surface of the eighth dielectric layer S8.

In this arrangement, the first, third, fifth, and seventh inner layer ground electrodes 44*a*, 44*c*, 44*e*, 44*g* are formed to oppose the respective first open ends of the first and second resonator elements 14*a*, 14*b*. The second, fourth, sixth, and eight inner layer ground electrodes 44*b*, 44*d*, 44*f*, 44*h* are formed to oppose the respective second resonator elements 14*a*, 14*b*.

The first to fourth inner layer ground electrodes 44*a* to 44*d* are electrically connected via through-holes 46*a* to 46*d* respectively to the inner layer ground electrode 40 formed on the first principal surface of the second dielectric layer S2. The fifth to eighth inner layer ground electrodes 44*e* to 44*h* are electrically connected via through-holes 46*e* to 46*h* respectively to the inner layer ground electrode 42 formed on the second principal surface of the ninth dielectric layer S9.

Two coupling-adjusting electrodes (first and second coupling-adjusting electrodes 50, 52), which are potentially in a floating state with respect to the ground electrode 24, the input/output terminal 22, and the antenna section 20, are formed on the first principal surface of the seventh dielectric layer S7.

The first and second coupling-adjusting electrodes 50, 52 are shaped such that strip-shaped first main electrode bodies 50*a*, 52*a*, which are opposed to the first resonator element 14*a*, are electrically connected to strip-shaped second main electrode bodies 50*b*, 52*b* which are opposed to the second resonator element 14*b*, by the aid of lead electrodes 50*c*, 52*c* formed therebetween.

Figure 4:
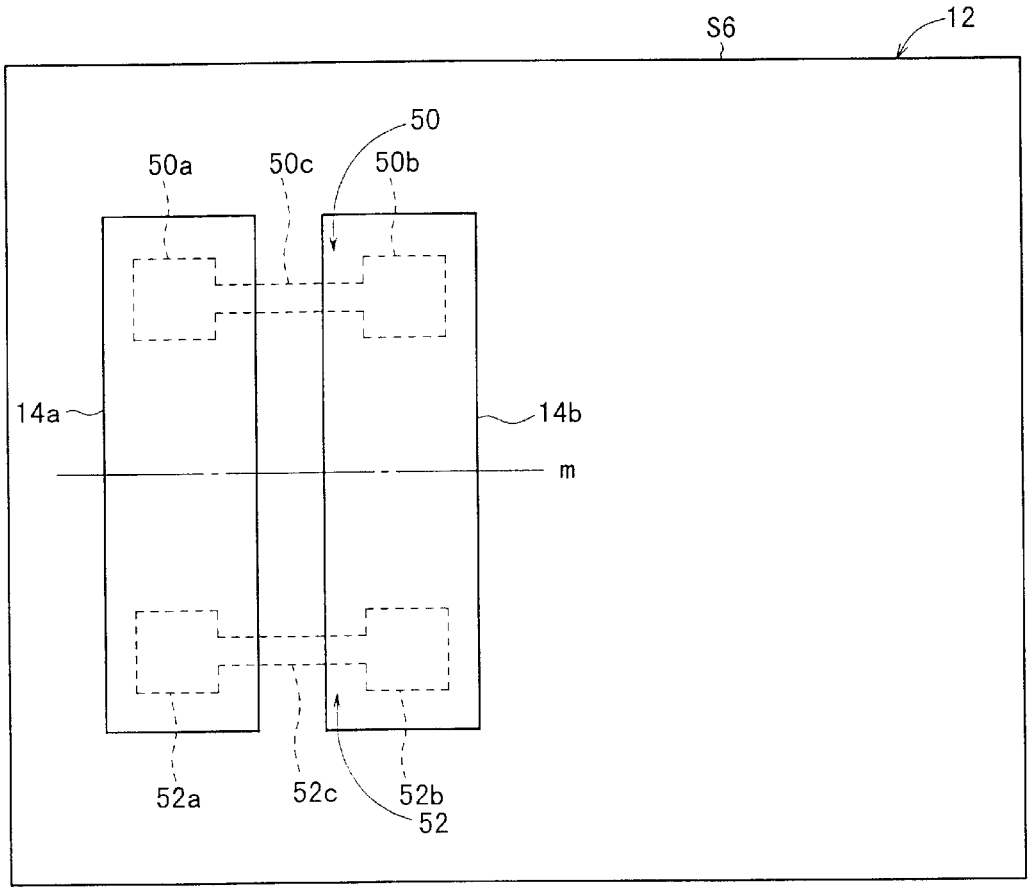
FIG. 4 illustrates patterns of electrodes formed on sixth and seventh dielectric layers of the antenna device according to the first embodiment.

Further, in this embodiment, as shown in FIG. 4, the first and second coupling-adjusting electrodes 50, 52 are formed at positions of linear symmetry with respect to a line m passing through centers in the length direction of the two resonator elements 14*a*, 14*b*.

The antenna device 10A according to the first embodiment is basically constructed as described above.

Explanation will now be made for the electric coupling concerning the respective electrodes with reference to FIGS. 2 and 3.

Figure 2:
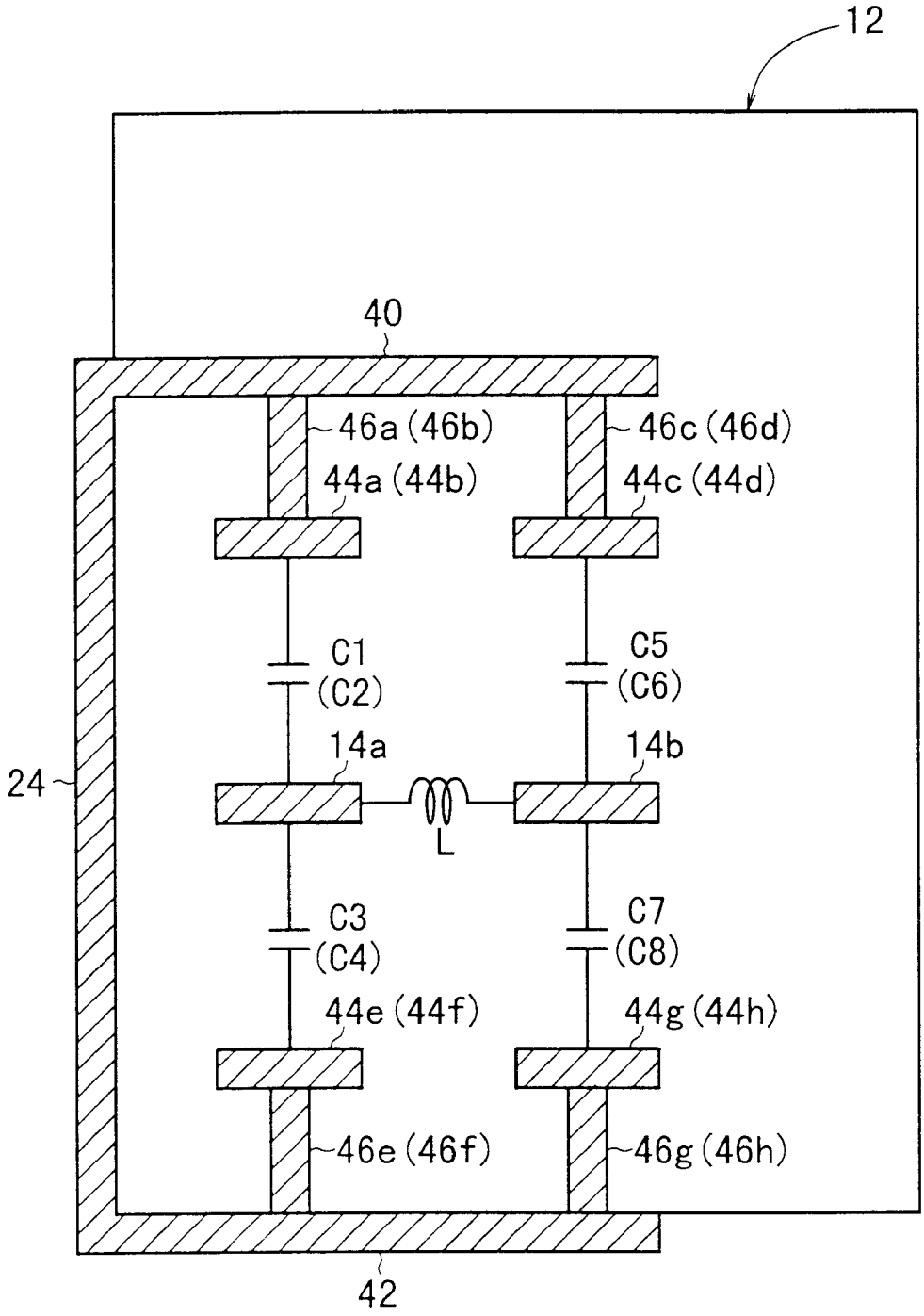
FIG. 2 shows a sectional view illustrating an arrangement obtained by cutting the antenna device according to the first embodiment in a direction perpendicular to a plane on which an inner layer ground electrode is formed.

At first, as shown in FIG. 2, capacitances C1, C2, C3, C4 are formed between both open ends of the first resonator element 14A and the first, second, fifth, and sixth inner layer ground electrodes 44*a*, 44*b*, 44*e*, 44*f* respectively. Capacitances C5, C6, C7, C8 are formed between both open ends of the second resonator element 14*b* and the third, fourth, seventh, and eight inner layer ground electrodes 44*c*, 44*d*, 44*g*, 44*h* respectively.

The respective adjoining resonator elements 14*a*, 14*b* are inductively coupled to one another. Accordingly, the equivalent circuit is formed such that an inductance L is inserted between the adjoining resonator elements 14*a*, 14*b*.

As shown in FIG. 3, a capacitance C9 is formed between the first resonator element 14*a* and the input/output electrode 26. Capacitances C10 and C11 are formed between the second resonator element 14*b* and the first input/output electrode 28 and between the second resonator element 14*b* and the second input/output electrode 30 respectively.

Further, capacitances C12 and C13 are formed between the first resonator element 14*a* and the first coupling-adjusting electrode 50 and between the first coupling-adjusting electrode 50 and the second resonator element 14*b* respectively. Capacitances C14 and C15 are formed between the first resonator element 14*a* and the second coupling-adjusting electrode 52 and between the second coupling-adjusting electrode 52 and the second resonator element 14*b* respectively.

As described above, the antenna device 10A according to the first embodiment is provided with the dielectric substrate 12 comprising a large number of stacked dielectric layers with at least the input/output terminal 22 and the ground electrode 24 which are formed on the outer circumferential surface thereof. The filter section 16 is constructed by the first and second resonator elements 14*a*, 14*b* which are arranged in parallel to one another in the dielectric substrate 12 respectively. The antenna section 20 is formed on the upper surface of the dielectric substrate 12.

The first and second resonator elements 14*a*, 14*b*, which are used for the filter section 16, are formed such that both ends are open. Therefore, it is unnecessary for the first and second resonator elements 14*a*, 14*b* to be formed to extend up to the end of the dielectric substrate 12. The resonance frequency is not dispersed, for example, by any variation in substrate size depending on the production process. Therefore it is possible to provide the high performance antenna device 10A.

The two input/output electrodes 28, 30 which are arranged at the positions of linear symmetry with respect to the center in the length direction of at least the second resonator element of the first and second resonator elements 14*a*, 14*b*, are provided in the dielectric substrate 12. The first and second input/output electrodes 28, 30 are connected to the first and second input/output terminals 32, 34 of the antenna section 20 respectively. Therefore, it is possible to appropriately select and perform the balanced input (output) and the unbalanced input (output) for the connection with the antenna section 20. The antenna (for example, the dipole antenna 18) based on the balanced input/output can be used as the antenna section 20.

As for the filter section 16 as described above, the balanced output can be obtained by obtaining the output from the two electrodes disposed at the symmetric positions with respect to the middle point of the first and second resonator elements 14*a*, 14*b*. On the other hand, it is possible to effect the resonance when antiphase signals are input at the symmetric positions with respect to the middle point of the first and second resonator elements 14*a*, 14*b*. Accordingly, it is possible to effect the balanced input.

In the conventional technique, in order to connect the filter to the antenna element based on the balanced input/output system, it has been necessary to add the balun therebetween. On the contrary, in this embodiment, the balanced input (output) and the unbalanced input (output) can be appropriately selected and performed for the connection with the antenna section 20. Therefore, the connection can be made with the antenna section 20 based on the balanced input/output without using any excessive circuit parts such as the balun. This contributes to the realization of the small size and the high performance of the antenna device 10A. Consequently, it is possible to reliably realize the small size and the high performance of the electronic instrument (including the communication instrument) provided with the antenna.

In this embodiment, the filter section 16 is provided with the first and second coupling-adjusting electrodes 50, 52 which are overlapped with the adjoining first and second resonator elements 14*a*, 14*b* with the sixth dielectric layer S6 interposed therebetween in the dielectric substrate 12 and which effect the capacitive coupling for the adjoining first and second resonator elements 14*a*, 14*b*. Therefore, the capacitances are formed between the first and second coupling-adjusting electrodes 50, 52 and the first resonator element 14*a* and between the first and second coupling-adjusting electrodes 50, 52 and the second resonator element 14*b* respectively. The equivalent circuit is formed such that the combined capacitance of these capacitances is connected in parallel to the inductance L formed between the adjoining first and second resonator elements 14*a*, 14*b*. Therefore, it is possible to adjust the degree of the coupling by means of the capacitance. Thus, it is possible to obtain the filter having a desired band width.

The capacitance can be easily adjusted by changing the overlapped areal size of the first and second resonator elements 14*a*, 14*b* and the first and second coupling-adjusting electrodes 50, 52, the distance therebetween, and/or the permittivity $\epsilon r$ of the dielectric disposed therebetween.

In this arrangement, the combined capacitance brought about by the first and second coupling-adjusting electrodes 50 52 is connected in parallel to the inductance L between the first and second resonator elements 14*a*, 14*b*. Therefore, the parallel resonance circuit is inserted and connected between the adjoining first and second resonator elements 14*a*, 14*b*. The impedance of the parallel resonance circuit, which is composed of the capacitance and the inductance, is changed from the inductive to the capacitive at lower and higher than the parallel resonant frequency. Therefore, the coupling between the first and second resonator elements 14*a*, 14*b* can be made either inductive or capacitive by adjusting the value of the capacitance formed between the adjoining first and second resonator elements 14*a*, 14*b* and the first and second coupling-adjusting electrodes 50, 52 respectively.

It is now assumed that the coupling between the first and second resonator elements 14*a*, 14*b* is inductive. The parallel resonance point exists on the high frequency side of the pass band. Therefore, it is possible to obtain a 25 filter which has the attenuation pole on the high frequency side. On the other hand, when the coupling between the first and second resonator elements 14*a*, 14*b* is capacitive, the parallel resonance point exists on the low frequency side of the pass band. Therefore, it is possible to obtain a filter which has the attenuation pole on the low frequency side. In any case, it is possible to improve the attenuation characteristic of the filter.

Further, in this embodiment, the first and second coupling-adjusting electrodes 50, 52 are formed at the positions of linear symmetry with respect to the center in the length direction of the first and second resonator elements 14*a*, 14*b*. Therefore, it is possible to suppress the influence of the positional discrepancy between the first and second resonator elements 14*a*, 14*b* and the first and second coupling-adjusting electrodes 50, 52 in the production steps.

Specifically, the effect of the first and second coupling-adjusting electrodes 50, 52 is affected by the relative positions with respect to the first and second resonator elements 14*a*, 14*b*. However, when the first and second coupling-adjusting electrodes 50, 52 are formed at the positions of linear symmetry with respect to the center in the length direction of the first and second resonator elements 14*a*, 14*b*, the variations of effects of the first and second coupling-adjusting electrodes 50, 52 are offset with each other, even if the positional discrepancy occurs in the longitudinal direction of the first and second resonator elements 14*a*, 14*b*. Thus, it is possible to suppress the influence of the positional discrepancy between the first and second resonator elements 14*a*, 14*b* and the first and second coupling-adjusting electrodes 50, 52.

In the embodiment of the present invention, the inner layer ground electrodes 44*a* to 44*h* are provided, which are arranged to overlap both open ends of the first and second resonator elements 14*a*, 14*b* with the dielectric layer interposed therebetween. Accordingly, the capacitances, which are formed between both open end sides of the first and second resonator elements 14*a*, 14*b* and the inner layer ground electrodes 44*a* to 44*h*, are also added to the capacitance of the parallel resonance circuit obtained by the equivalent transformation of the first and second resonator elements 14*a*, 14*b*. Therefore, assuming that the resonance frequency is identical, it is enough that the parallel resonance circuit has a small inductance. As a result, it is possible to further decrease the length of the first and second resonator elements 14*a*, 14*b* (resonator length). Thus, it is possible to shorten the length of the entire filter section 16.

In this case, the following problem may arise. That is, when the opposing areal size of the inner layer ground electrodes 44*a* to 44*h* and the first and second resonator elements 14*a*, 14*b* is increased in order to realize a small size of the filter section 16, the inductive coupling between the first and second resonator elements 14*a*, 14*b* becomes stronger, resulting in a too broad band of the filter characteristic.

However, in the embodiment of the present invention, the first and second coupling-adjusting electrodes 50, 52 are provided as described above. Therefore, owing to the capacitance formed between the first and second coupling-adjusting electrodes 50, 52 and the first and second resonator elements 14*a*, 14*b*, the absolute value of the total susceptance, which is formed by the capacitance between the first and second resonator elements 14*a*, 14*b* and the inductive coupling between the first and second resonator elements 14*a*, 14*b*, is changed. Therefore, the degree of the coupling between the first resonator element 14*a* and the second resonator element 14*b* can be adjusted by adjusting the value of the capacitance. Thus, it is possible to obtain the filter having a desired band width.

Even when any stacking discrepancy occurs in the longitudinal direction (axial direction) of the first and second resonator elements 14*a*, 14*b* concerning the first and second resonator elements 14*a*, 14*b* and the inner layer ground electrodes 44*a* to 44*h*, it is possible to decrease the dispersion of the resonance frequency, because the changes in capacitance at the respective open ends of the first and second resonator elements 14*a*, 14*b* are offset with each other.

Next, several modified embodiments concerning the antenna device 10A according to the first embodiment will be explained with reference to FIGS. 5 to 7. Components or parts corresponding to those shown in FIG. 1 are designated by the same reference numerals, duplicate explanation of which will be omitted.

Figure 5:
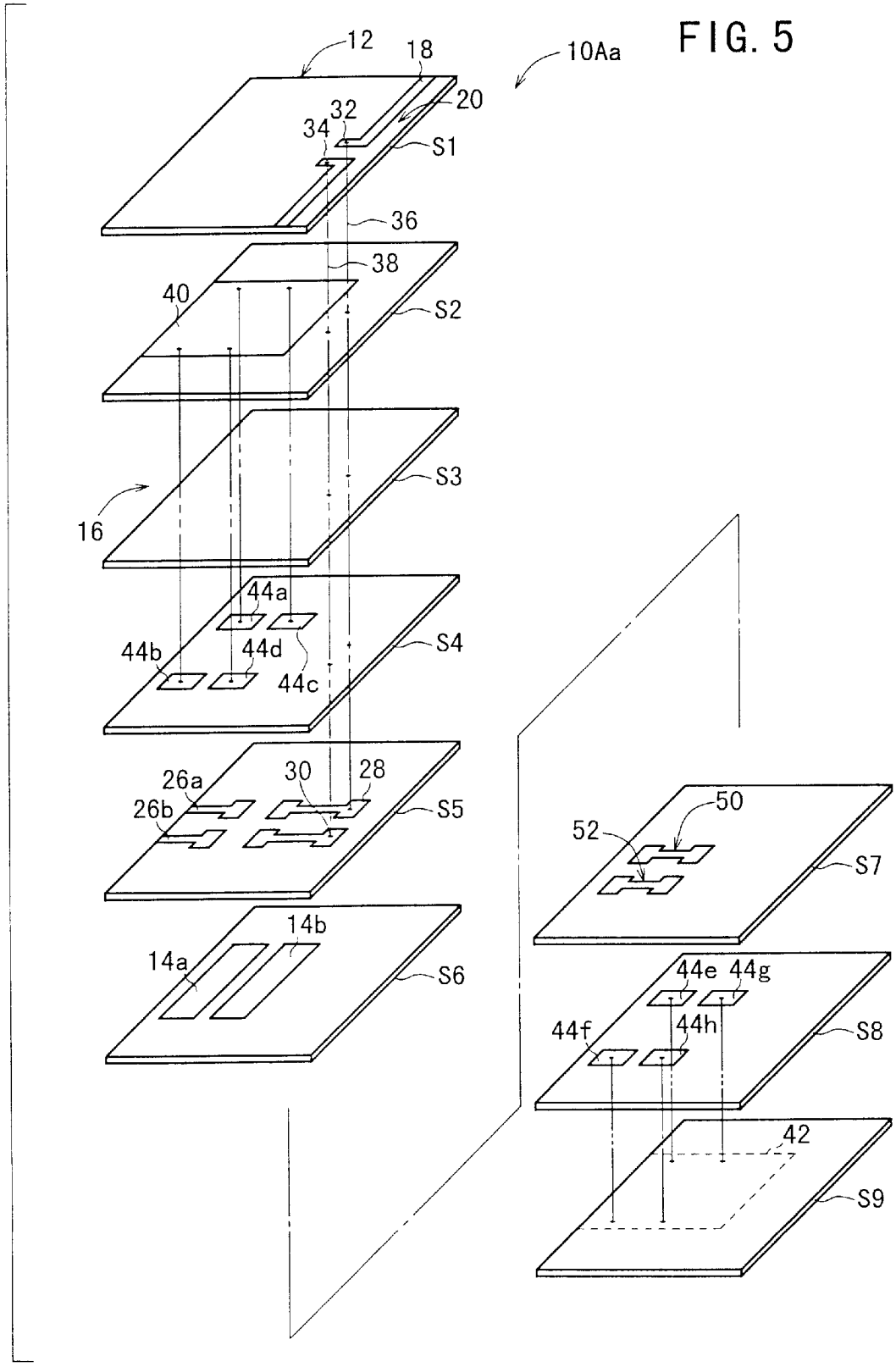
FIG. 5 shows an exploded perspective view illustrating an arrangement of a first modified embodiment of the antenna device according to the first embodiment.

At first, as shown in FIG. 5, an antenna device 10A*a* according to a first modified embodiment is constructed in approximately the same manner as the antenna device 10A according to the first embodiment (see FIG. 1). However, the former is different from the latter in that two input/output electrodes (first and second input/output electrodes 26*a*, 26*b*) are formed on the first principal surface of the fifth dielectric layer S5.

In this arrangement, the filter section 16 is connected to the antenna section 20 in accordance with the balanced input/output via the first and second input/output electrodes 28, 30 disposed on the side of the antenna section 20. The filter section 16 is connected to another circuit (unillustrated) in accordance with the balanced input/output via the first and second input/output electrodes 26*a*, 26*b* disposed on the opposite side.

In the antenna device 10A according to the first embodiment described above, the connection end with respect to the other unillustrated circuit is based on the unbalanced input/output in the filter section 16. In the antenna device 10A*a* according to the first modified embodiment, the connection end with respect to the other unillustrated circuit is based on the balanced input/output in the filter section 16. The various embodiments and the various modified embodiments concerning the present invention are equivalent even when the connection end with respect to the other unillustrated circuit is based on either the balanced input/output or the unbalanced input/output in the filter section 16. Therefore, the following explanation of the modified embodiments and the embodiments represents examples in which the connection end with respect to the other unillustrated circuit is based on the unbalanced input/output. Explanation for the balanced input/output will be omitted.

Figure 6:
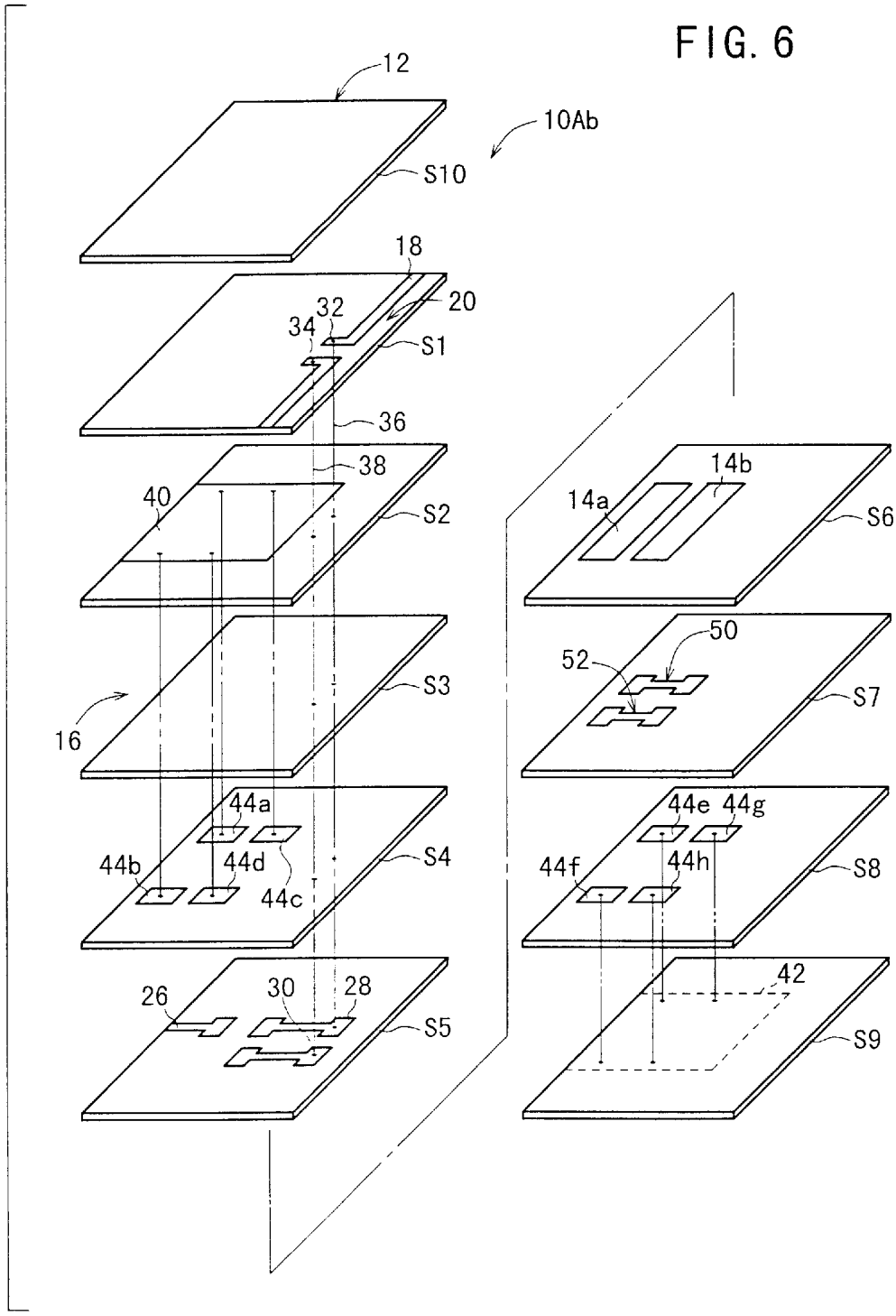
FIG. 6 shows an exploded perspective view illustrating an arrangement of a second modified embodiment of the antenna device according to the first embodiment.

Next, as shown in FIG. 6, an antenna device 10A*b* according to a second modified embodiment is constructed in approximately the same manner as the antenna device 10A according to the first embodiment (see FIG. 1). However, the former is different from the latter in that a tenth dielectric layer S10 is further superimposed on the first principal surface side of the first dielectric layer S1.

That is, the antenna device 10A according to the first embodiment described above is formed such that the antenna section 20 is exposed from the dielectric substrate 12. On the contrary, the antenna device 10A*b* according to the second modified embodiment is formed such that the antenna section 20 is embedded in the dielectric substrate 12.

Explanation will now be made for the difference between the case in which the antenna section 20 is formed on the surface of the dielectric substrate 12 and the case in which the antenna section 20 is formed at the inside of the dielectric substrate 12.

When the antenna section 20 is formed on the surface of the dielectric substrate 12, the effective dielectric constant is low as compared with the case in which the antenna section 20 is formed at the inside of the dielectric substrate 12, because of the following reason. That is, when the antenna section 20 is formed on the surface of the dielectric substrate 12, the effective dielectric constant is affected by the air, because the radiation conductor also faces the air (dielectric constant=1). Therefore, it is possible to realize the small size of the antenna section 20 when the antenna section 20 is formed at the inside of the dielectric substrate 12.

However, in general, if the dielectric substrate 12 is composed of a material having a high dielectric constant, problems arise in that the band width of the antenna section 20 is decreased, and the gain is lowered. Therefore, the dielectric constant of the dielectric to be used and the position of formation of the antenna to be used are determined while keeping the balance between the shape and 20 the required characteristic.

Figure 7:
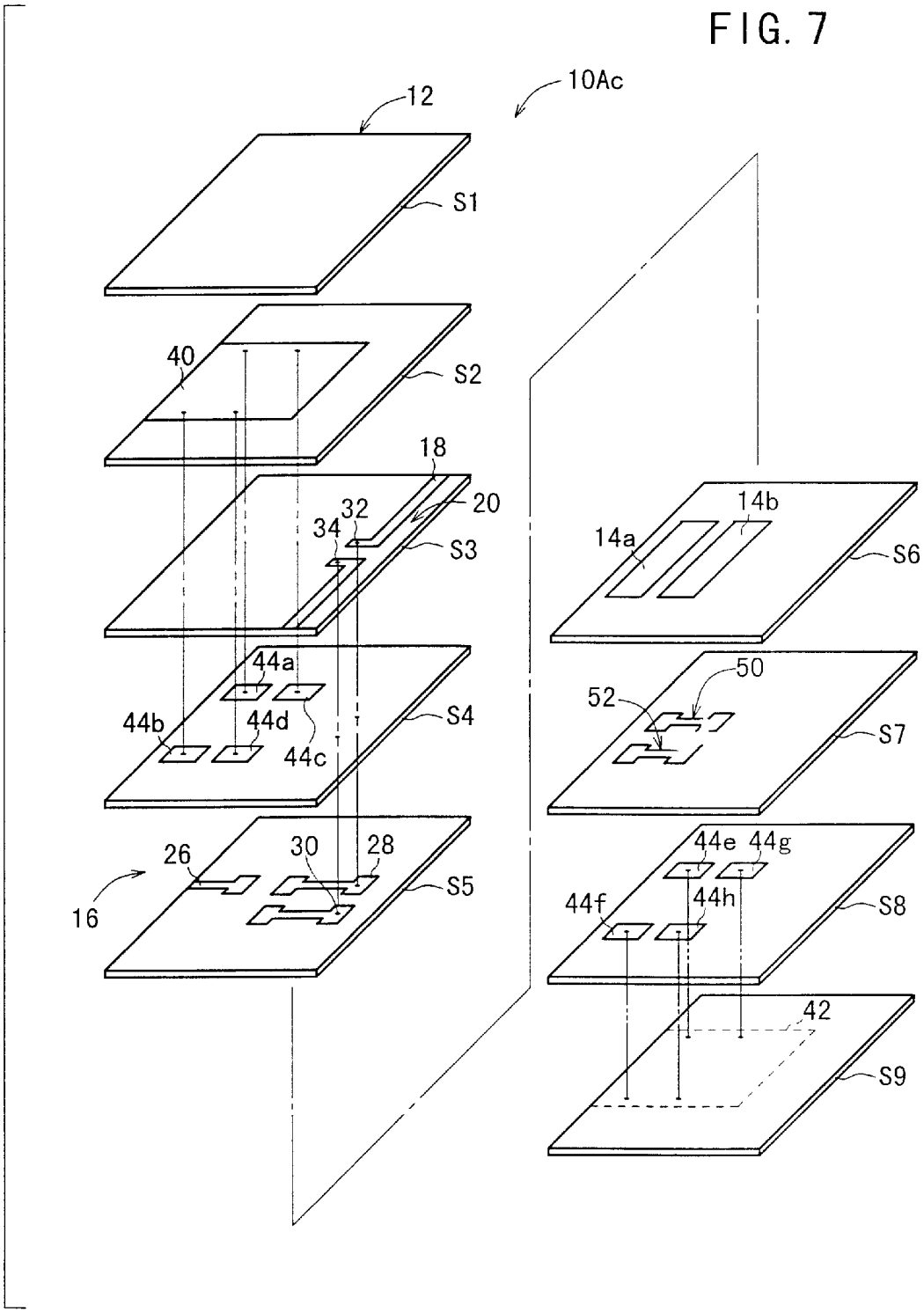
FIG. 7 shows an exploded perspective view illustrating an arrangement of a third modified embodiment of the antenna device according to the first embodiment.

Next, as shown in FIG. 7, an antenna device 10A*c* according to a third modified embodiment is constructed in approximately the same manner as the antenna device 10A according to the first embodiment (see FIG. 1). However, the former is different from the latter in that the antenna section 20 is not formed on the first principal surface of the first dielectric layer S1, but the antenna section 20 is formed on the first principal surface of the third dielectric layer S3.

That is, the antenna device 10A according to the first embodiment described above is formed such that the antenna section 20 is formed at the position over the filter section 16. On the contrary, the antenna device 10A*c* according to the third modified embodiment is formed such that the antenna section 20 is formed at approximately the same position as that of the filter section 16. This arrangement is based on the fact that it is not necessarily indispensable to dispose the antenna section 20 at the position over the filter section 16.

Next, an antenna device 10B according to a second embodiment will be explained with reference to FIGS. 8 and 9. Components or parts corresponding to those shown in FIG. 1 are designated by the same reference numerals, duplicate explanation of which will be omitted.

Figure 8:
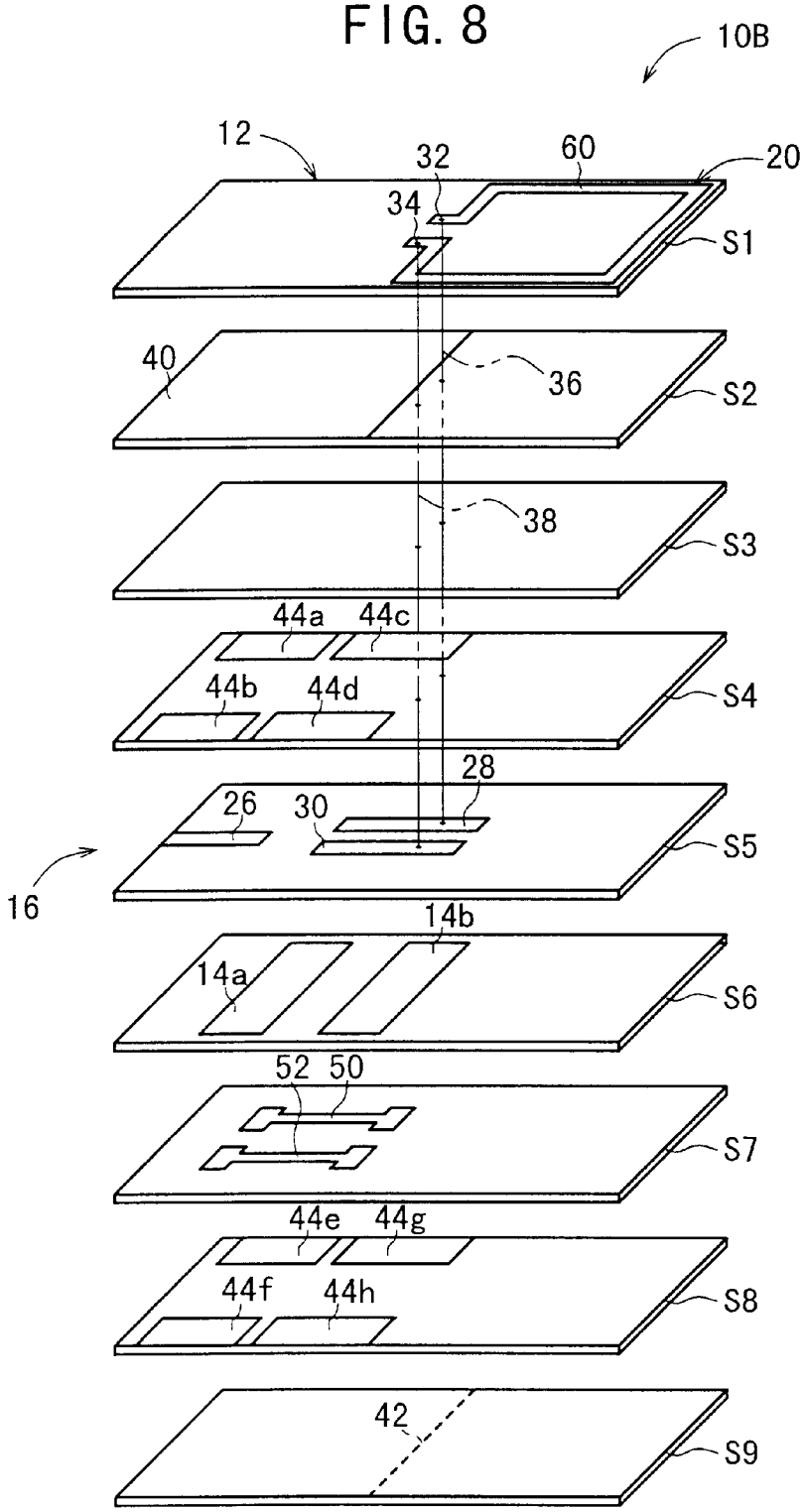
FIG. 8 shows an exploded perspective view illustrating an arrangement of an antenna device according to a second embodiment.

As shown in FIG. 8, the antenna device 10B according to the second embodiment is constructed in approximately the same manner as the antenna device 10A according to the first embodiment (see FIG. 1). However, the former is different from the latter in the following points. That is, the antenna section 20, which is formed on the first principal surface of the first dielectric layer S1, is a loop antenna 60. The inner layer ground electrodes 44*a* to 44*h*, which are formed on the respective first principal surfaces of the fourth dielectric layer S4 and the eighth dielectric layer S8, are directly connected to the ground electrode 24 formed on the front surface and the back surface of the dielectric substrate 12 as shown in FIG. 9. The inner layer ground electrodes 40, 42, which are formed on the first principal surface of the second dielectric layer S2 and the second principal surface of the ninth dielectric layer S9, are formed in an enlarged manner to arrive at the front surface and the back surface of the dielectric substrate 12.

Also in the antenna device 10B according to the second embodiment, the first and second resonator elements 14*a*, 14*b*, which are used for the filter section 16, are formed such that both ends are open in the same manner as in the antenna device 10A according to the first embodiment described above. Therefore, it is unnecessary to form the resonator so that it extends up to the end of the dielectric substrate 12. The resonance frequency is not dispersed even by the variation of the substrate size due to the production process or the like. Therefore, it is possible to provide the high performance antenna device 10B.

The first and second input/output electrodes 28, 30 are provided in the dielectric substrate 12, which are arranged at the positions of linear symmetry with respect to the center in the length direction of at least the second resonator element 14*b* of the first and second resonator elements 14*a*, 14*b*. The first and second input/output electrodes 28, 30 are connected to the first and second input/output terminals 32, 34 of the antenna section 20 respectively. Accordingly, it is possible to appropriately select and perform the balanced input (output) and the unbalanced input (output) for the connection with the antenna section 20. Thus, the connection can be made with the antenna section 20 based on the balanced input/output without using any excessive circuit parts such as the balun.

This contributes to the realization of the small size and the high performance of the antenna device 10B. Consequently, it is possible to reliably realize the small size and the high performance of the electronic instrument (including the communication instrument) provided with the antenna.

This embodiment is also provided with the first and second coupling-adjusting electrodes 50, 52. Therefore, it is possible to obtain the filter having a desired band width.

Next, several modified embodiments concerning the antenna device 10B according to the second embodiment will be explained with reference to FIGS. 10 to 16. Components or parts corresponding to those shown in FIG. 8 are designated by the same reference numerals, duplicate explanation of which will be omitted.

Figure 10:
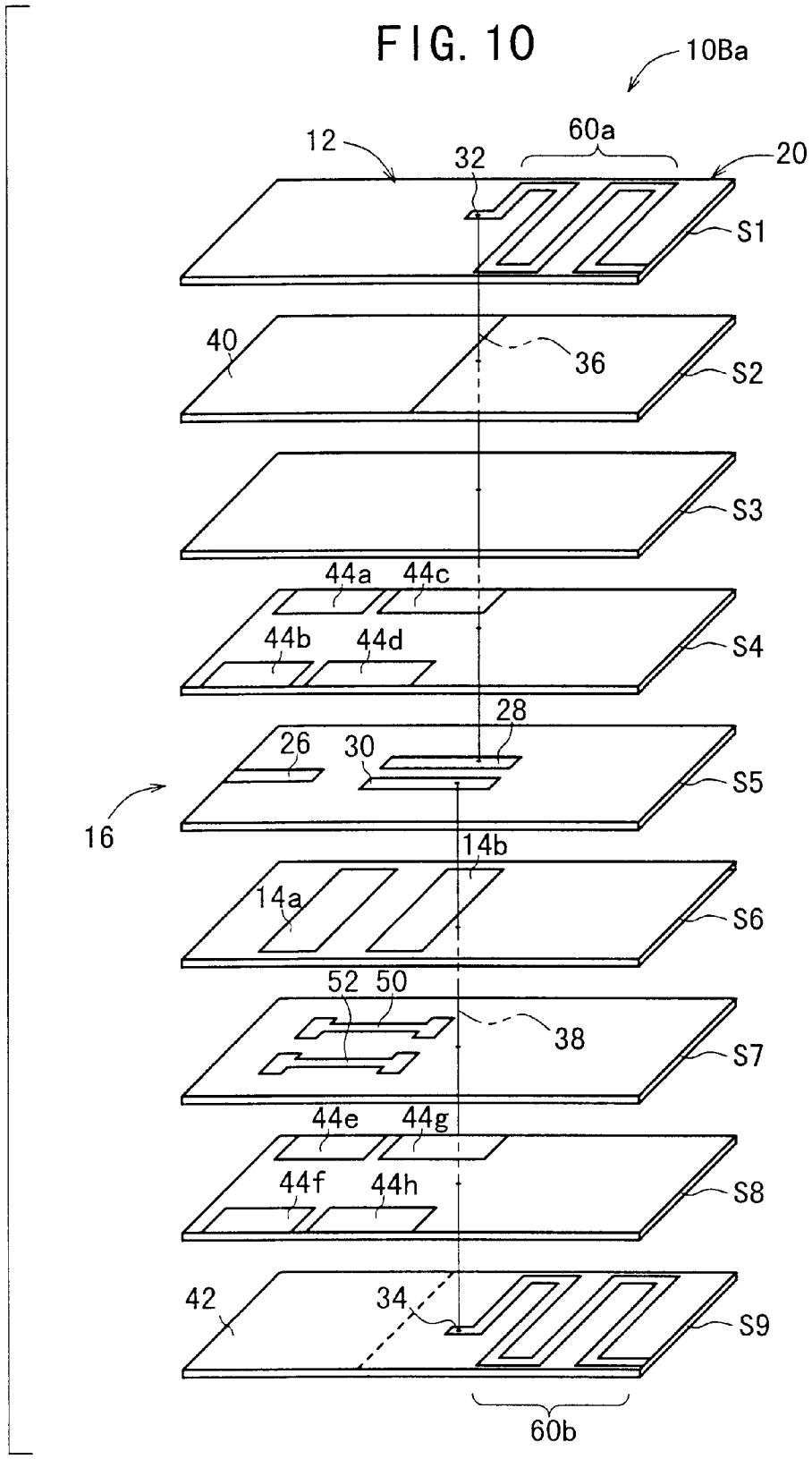
FIG. 10 shows an exploded perspective view illustrating an arrangement of a first modified embodiment of the antenna device according to the second embodiment.
Figure 11:
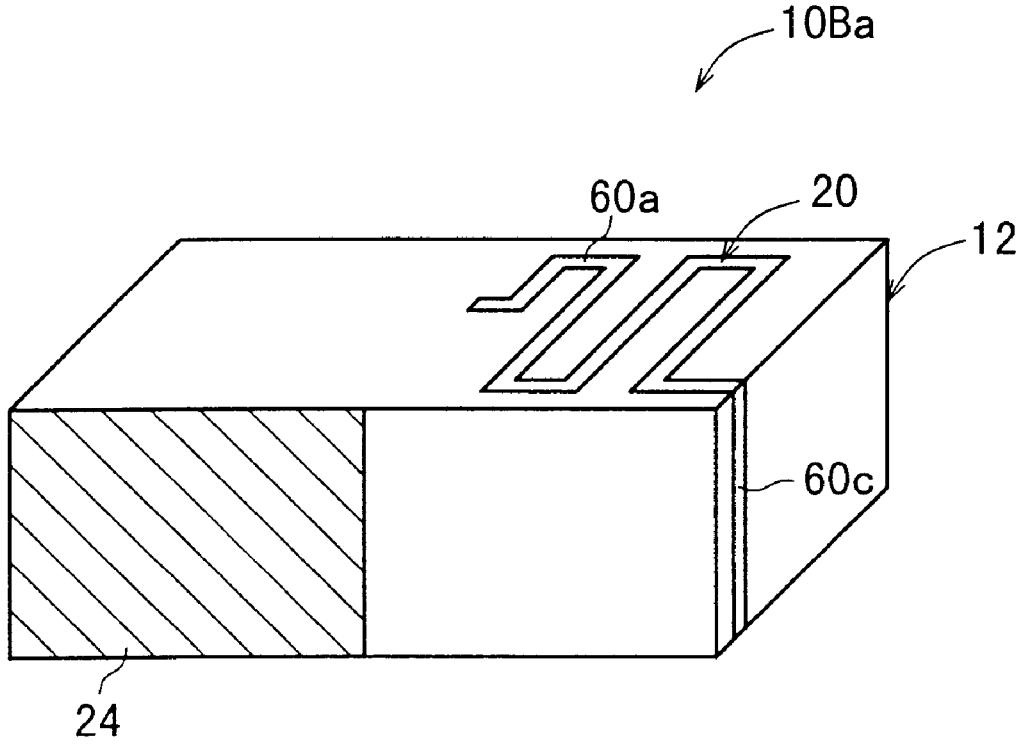
FIG. 11 shows a perspective view illustrating an appearance of the first modified embodiment of the antenna device according to the second embodiment.

At first, as shown in FIG. 10, an antenna device 10B*a* according to a first modified embodiment is constructed in approximately the same manner as the antenna device 10B according to the second embodiment (see FIG. 8). However, the former is different from the latter in that a loop antenna 60 (antenna section 20) is constructed by a first meandering pattern 60*a* based on an electrode film formed on the first principal surface of the first dielectric layer S1, a second meandering pattern 60*b* based on an electrode film formed on the first principal surface of the ninth dielectric layer S9, and a conductor pattern 60*c* formed on the right side surface of the dielectric substrate 12 as shown in FIG. 11 for electrically connecting a first end of the first meandering pattern 60*a* and a first end of the second meandering pattern 60*b*.

In this arrangement, a second end (first input/output terminal 32) of the first meandering pattern 60*a* is electrically connected with the first input/output electrode 28 via the through-hole 36. A second end (second input/output terminal 34) of the second meandering pattern 60*b* is electrically connected with the second input/output electrode 30 via the through-hole 38.

In the first modified embodiment, the meandering patterns 60*a*, 60*b* are included in the loop antenna 60 (antenna section 20). Therefore, it is possible to lengthen the effective antenna length, and it is possible to realize the small size of the antenna section 20 corresponding thereto.

Figure 12:
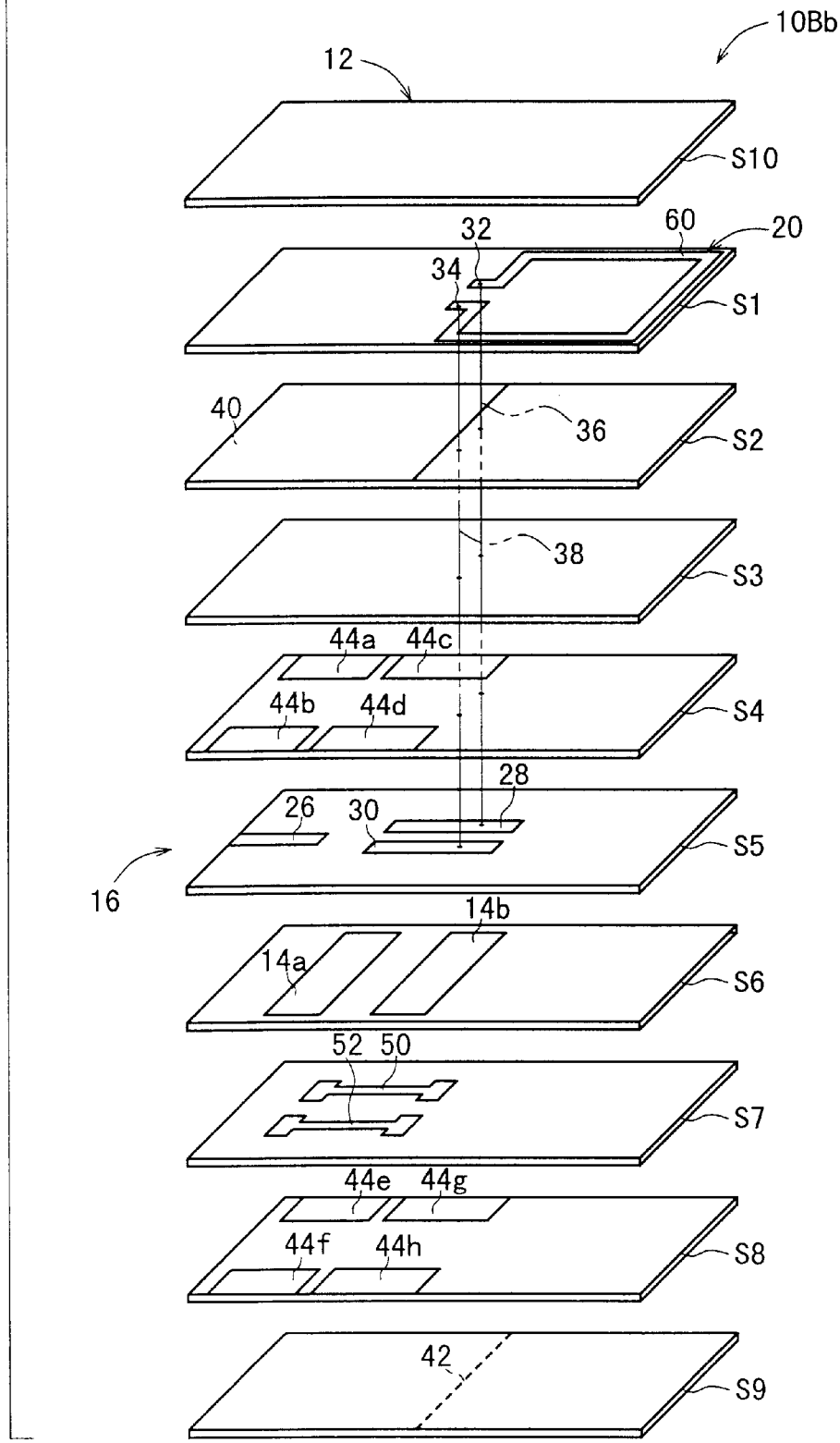
FIG. 12 shows an exploded perspective view illustrating an arrangement of a second modified embodiment of the antenna device according to the second embodiment.

Next, as shown in FIG. 12, an antenna device 10B*b* according to a second modified embodiment is constructed in approximately the same manner as the antenna device 10B according to the second embodiment (see FIG. 8). However, the former is different from the latter in that a tenth dielectric layer S10 is further superimposed on the first principal surface side of the first dielectric layer S1.

That is, the antenna device 10B according to the second embodiment described above is formed such that the antenna section 20 is exposed from the dielectric substrate 12. However, the antenna device 10B*b* according to the second modified embodiment is formed such that the antenna section 20 is embedded in the dielectric substrate 12.

In this arrangement, the effective dielectric constant of the antenna section 20 is increased as compared with the case in which the antenna section 20 is formed on the surface of the dielectric substrate 12. Therefore, it is possible to realize the small size of the antenna section 20.

Figure 13:
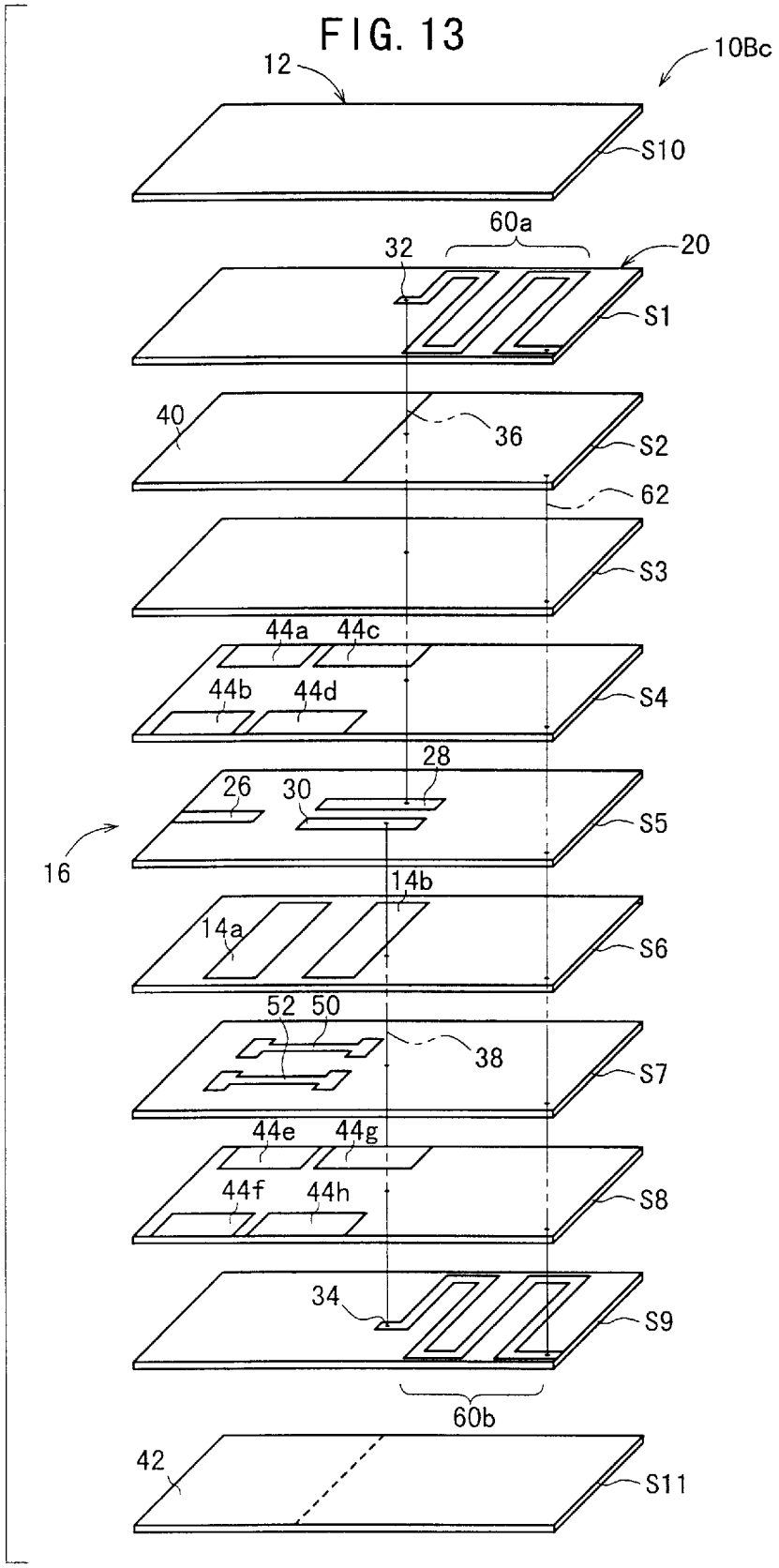
FIG. 13 shows an exploded perspective view illustrating an arrangement of a third modified embodiment of the antenna device according to the second embodiment.

Next, as shown in FIG. 13, an antenna device 10B*c* according to a third modified embodiment is constructed in approximately the same manner as the antenna device 10B*a* according to the first modified embodiment (see FIG. 10). However, the former is different from the latter in that a tenth dielectric layer S10 is further stacked on the first principal surface side of the first dielectric layer S1, an eleventh dielectric layer S11 is further stacked on the second principal surface side of the ninth dielectric layer S9, and the first end of the first meandering pattern 60*a* is electrically connected to the first end of the second meandering pattern 60*b* via a through-hole 62 at the inside of the dielectric substrate 12.

That is, the antenna device 10B*a* according to the first modified embodiment is formed such that the antenna section 20 is exposed from the dielectric substrate 12. However, the antenna device 10B*c* according to the third modified embodiment is formed such that the antenna section 20 is embedded in the dielectric substrate 12.

In this arrangement, the effective dielectric constant of the antenna section 20 is higher than that of the case in which the antenna section 20 is formed on the surface of the dielectric substrate 12. Further, the effective antenna length is elongated owing to the meandering patterns 60*a*, 60*b*. Therefore, it is possible to realize the smaller size of the antenna section 20.

Figure 9:
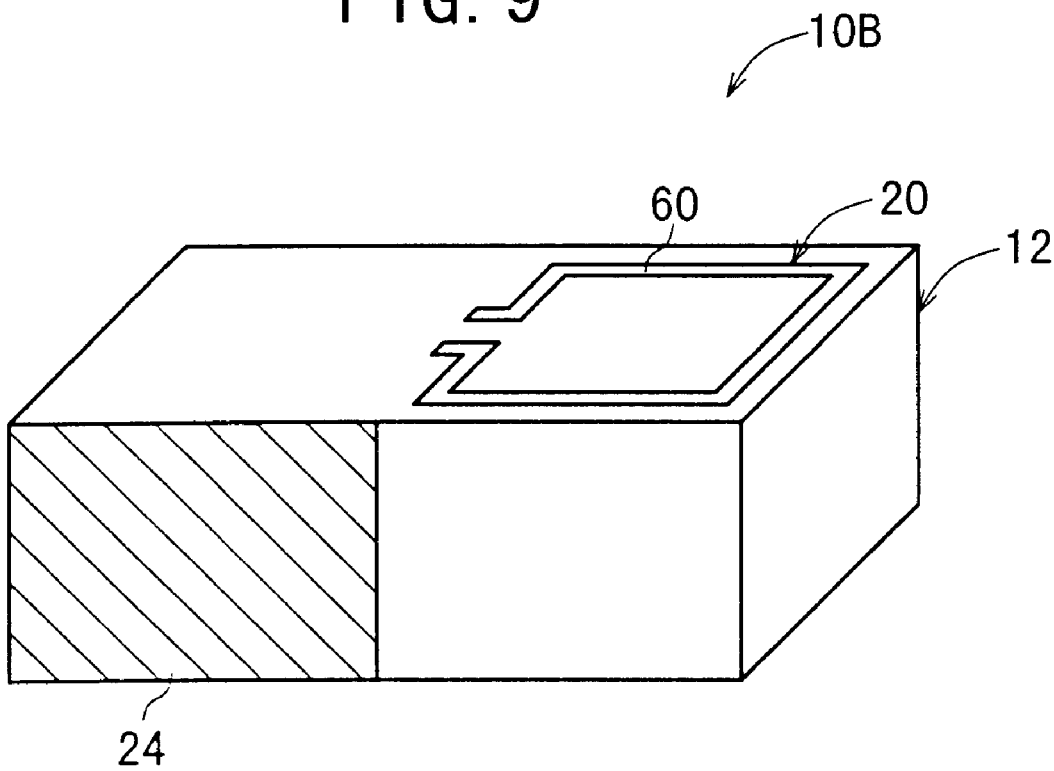
FIG. 9 shows a perspective view illustrating an appearance of the antenna device according to the second embodiment.
Figure 14:
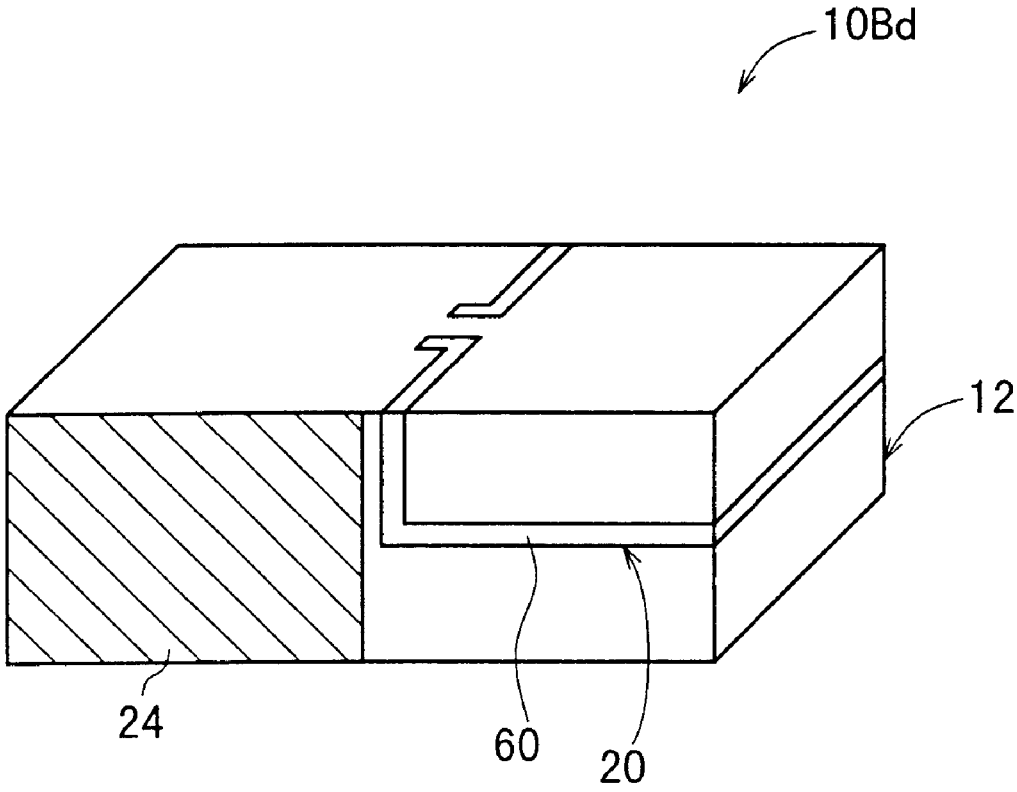
FIG. 14 shows a perspective view illustrating an appearance of the fourth modified embodiment of the antenna device according to the second embodiment.

Next, as shown in FIG. 14, an antenna device 10B*d* according to a fourth modified embodiment is constructed in approximately the same manner as the antenna device 10B according to the second embodiment (see FIG. 9). However, the former is different from the latter in that the loop antenna 60 for constructing the antenna section 20 is formed over the upper surface, the front surface, the right side surface, and the back surface of the dielectric substrate 12.

Also in this arrangement, it is possible to provide a long effective antenna length. Therefore it is possible to achieve the small size of the antenna section 20.

Figure 15:
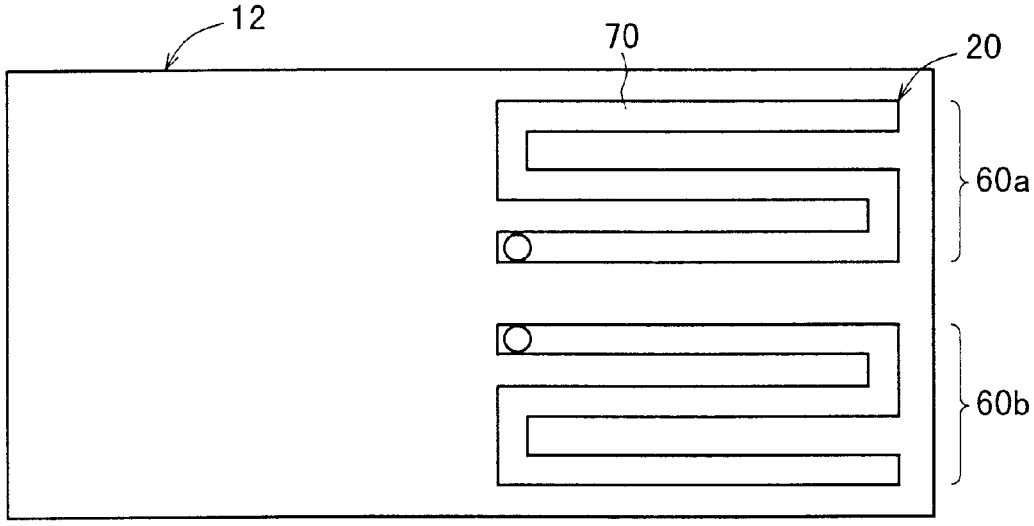
FIG. 15 shows a plan view illustrating a dipole antenna composed of a first meandering pattern and a second meandering pattern.

The antenna device 20B according to the second embodiment and the antenna devices 10B*a* to 10B*d* according to the first to fourth modified embodiments thereof described above are illustrative of the case in which the loop antenna 60 is used for the antenna section 20. However, as shown in FIG. 15, it is also preferable to use a dipole antenna 70 comprising a first meandering pattern 60*a* and a second meandering pattern 60*b*.

Figure 16:
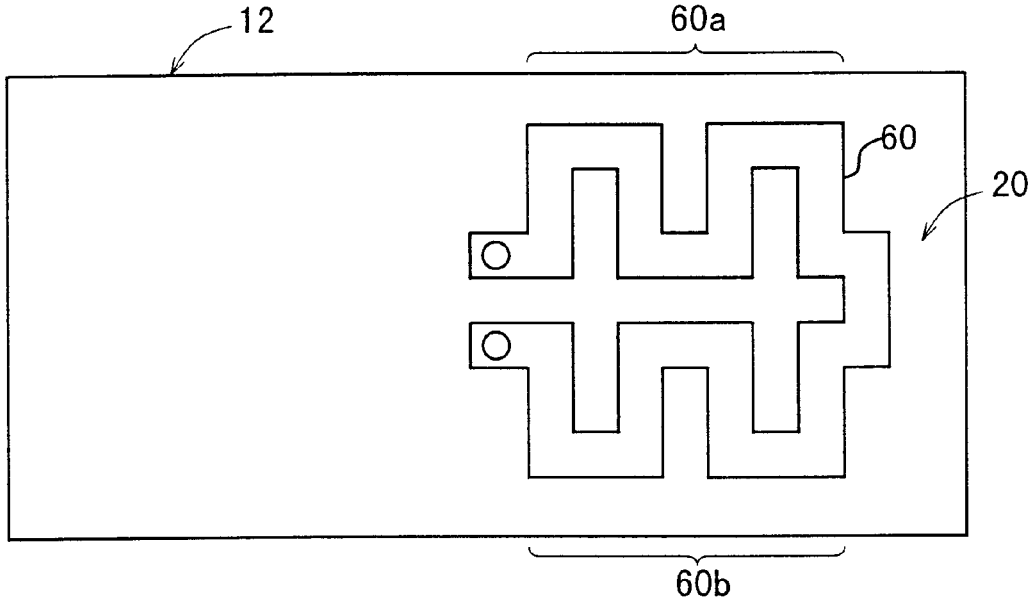
FIG. 16 shows a plan view illustrating a loop antenna composed of a first meandering pattern and a second meandering pattern.

The antenna devices 10B*a* and 10B*c* according to the first and third modified embodiments are illustrative of the case in which the first meandering pattern 60*a* and the second meandering pattern 60*b* are formed on the different dielectric layers respectively. Alternatively, as shown in FIG. 16, it is also preferable that the first meandering pattern 60*a* and the second meandering pattern 60*b* are formed on the identical dielectric layer (for example, on the first principal surface of the first dielectric layer S1).

One of the methods for miniaturizing the electronic part is, for example, the use of a high dielectric constant material.

In this case, the high dielectric constant material can be used for the filter section 16 without any special problem. However, the antenna section 20 causes problems such as the low gain and the decrease in the band width of the antenna, as the dielectric constant of the material becomes high. An antenna device 10C according to a third embodiment described below solves such problems.

The antenna device 10C according to the third embodiment will be explained with reference to FIG. 17. Components or parts corresponding to those shown in FIG. 1 are designated by the same reference numerals, duplicate explanation of which will be omitted.

Figure 17:
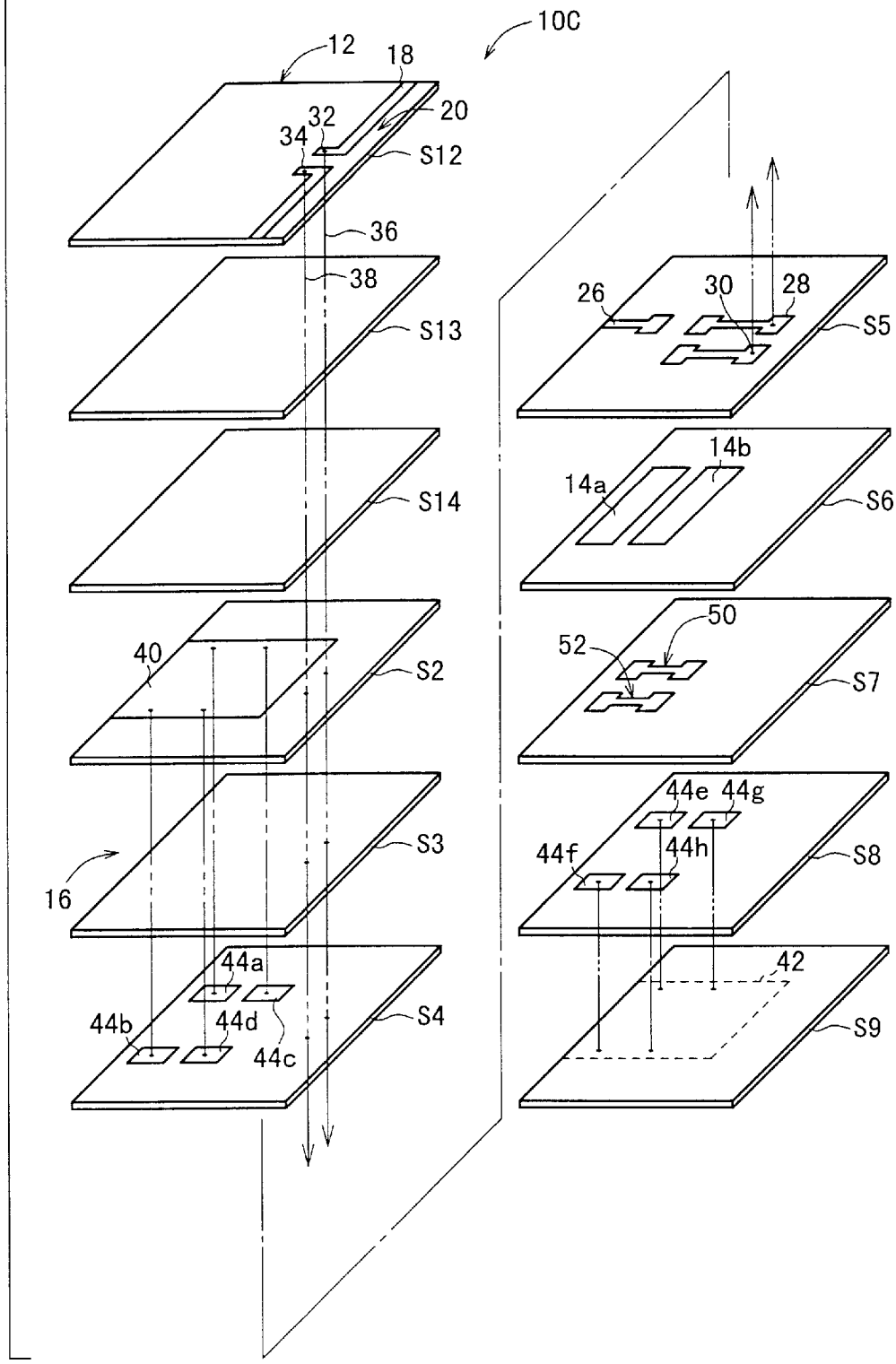
FIG. 17 shows an exploded perspective view illustrating an arrangement of an antenna device according to a third embodiment.

As shown in FIG. 17, the antenna device 10C according to the third embodiment is constructed in approximately the same manner as the antenna device 10A according to the first embodiment (see FIG. 1). However, the former is different from the latter in the following points. That is, a twelfth dielectric layer S12, which has a low dielectric constant as compared with the first to ninth dielectric layers S1 to S9, is used in place of the first dielectric layer S1 on which the antenna section 20 is formed. The antenna section 20 is formed on the first principal surface of the twelfth dielectric layer S12. Thirteenth and fourteenth dielectric layers S13 and S14, each of which has a low dielectric constant, are stacked between the twelfth dielectric layer S12 and the second dielectric layer S2. Of course, each of the twelfth to fourteenth dielectric layers S12 to S14 is composed of one or a plurality of layers in the same manner as the first to eleventh dielectric layers S1 to S11.

As described above, in the antenna device 10C according to the third embodiment, the dielectric layers S2 to S9 having the high dielectric constant can be used for the filter section 16, and the dielectric layers S12 to S14 having the low dielectric constant can be used for the antenna section 20. Therefore, it is possible to realize the small size of the filter section 16. Simultaneously, it is possible to effectively suppress the low gain and the decrease in band width in the antenna section 20.

Next, a modified embodiment of the antenna device 10C according to the third embodiment will be explained with reference to FIG. 18. Components or parts corresponding to those shown in FIG. 17 are designated by the same reference numerals, duplicate explanation of which will be omitted.

Figure 18:
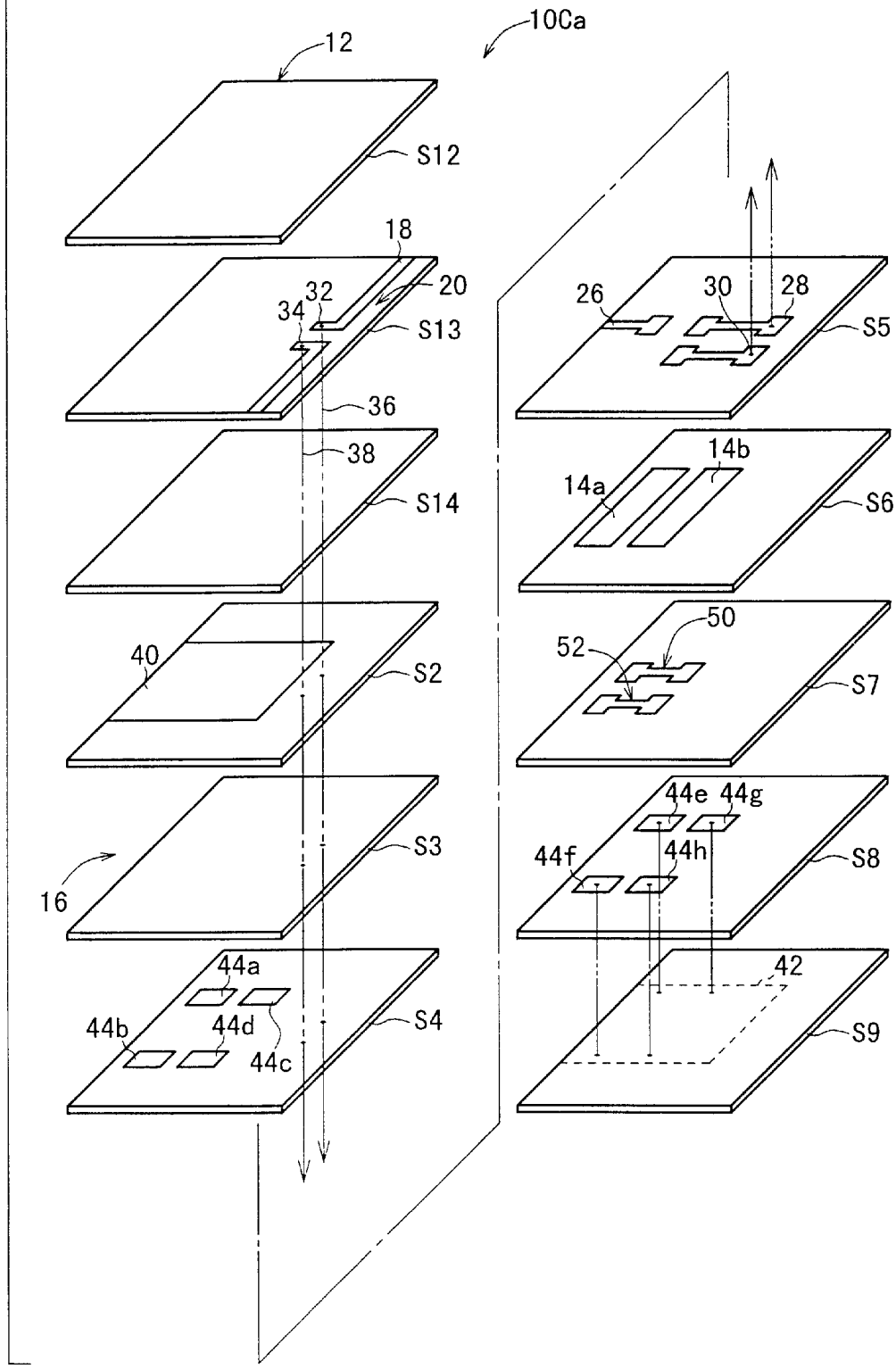
FIG. 18 shows an exploded perspective view illustrating an arrangement of a modified embodiment of the antenna device according to the third embodiment.

As shown in FIG. 18, an antenna device 10C*a* according to this modified embodiment is constructed in approximately the same manner as the antenna device 10C according to the third embodiment (see FIG. 17). However, the former is different from the latter in that the antenna section 20 is formed on the first principal surface of the thirteenth dielectric layer S13.

That is, the antenna device 10C according to the third embodiment described above is formed such that the antenna section 20 is exposed from the dielectric substrate 12. However, the antenna device 10C*a* according to this modified embodiment is formed such that the antenna section 20 is embedded in the dielectric substrate 12.

In this embodiment, the effective dielectric constant of the antenna section 20 is high as compared with the case in which the antenna section 20 is formed on the surface of the dielectric substrate 12. Therefore, it is possible to realize the small size of the antenna section 20.

Next, an antenna device 10D according to a fourth embodiment will be explained with reference to FIG. 19. Components or parts corresponding to those shown in FIG. 8 are designated by the same reference numerals, duplicate explanation of which will be omitted.

Figure 19:
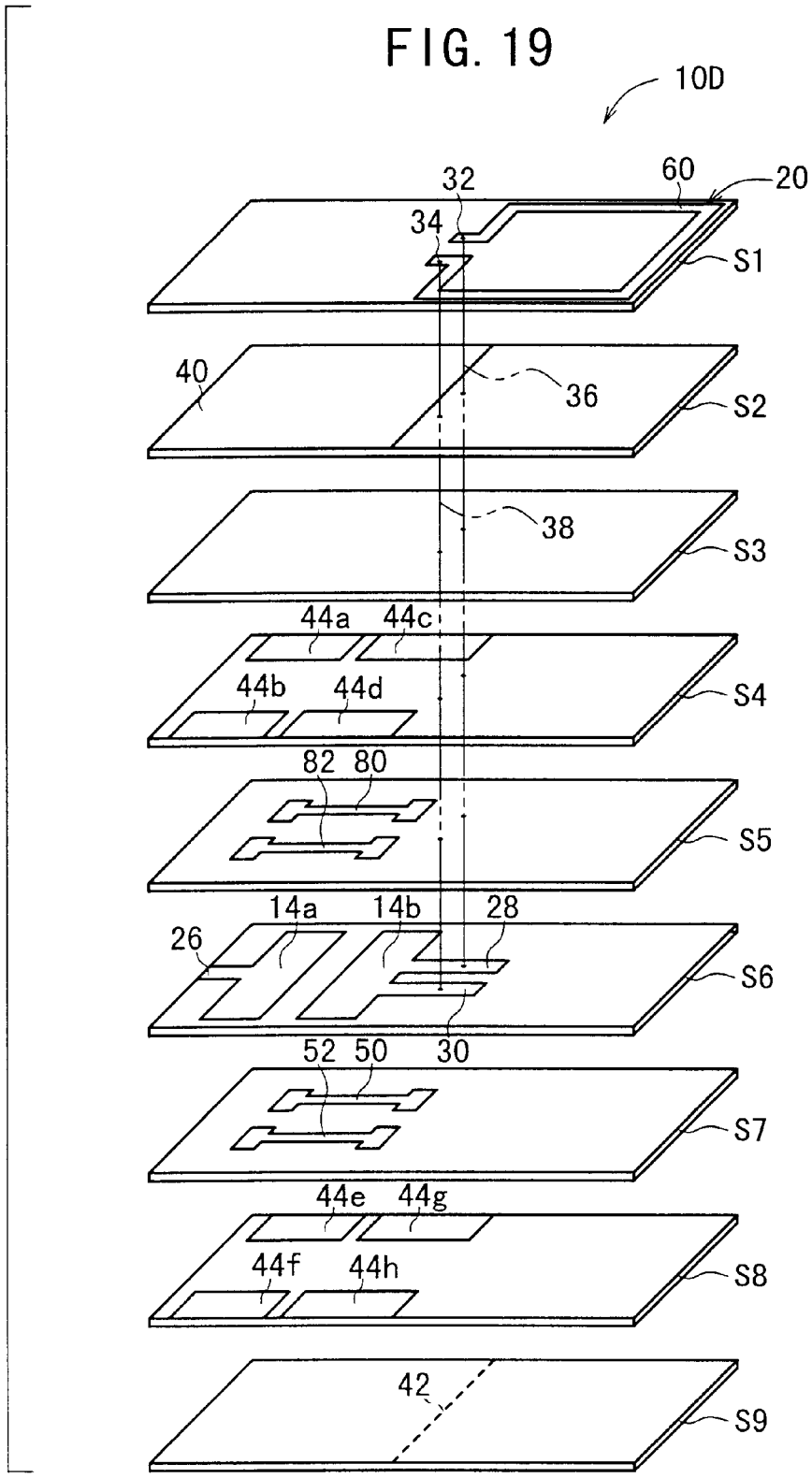
FIG. 19 shows an exploded perspective view illustrating an arrangement of an antenna device according to a fourth embodiment.

As shown in FIG. 19, the antenna device 10D according to the fourth embodiment is constructed in approximately the same manner as the antenna device 10B according to the second embodiment (see FIG. 8). However, the former is different from the latter in the following points. That is, the input/output electrode 26 is directly connected to the first resonator element 14*a* which is formed on the first principal surface of the sixth dielectric layer S6. The first and second input/output electrodes 28, 30 are directly formed on the second resonator element 14*b*. Third and fourth coupling-adjusting electrodes 80, 82, which are constructed in the same manner as the first and second coupling-adjusting electrodes 50, 52 formed on the seventh dielectric layer S7, are formed on the first principal surface of the fifth dielectric layer S5.

In other words, in the antenna device 10D according to the fourth embodiment, the input/output terminal 22 formed on the left side surface of the dielectric layer 12 is directly connected to the first resonator element 14*a* in the dielectric substrate 12 via the input/output electrode 26. The first and second input/output terminals 32, 34 of the antenna section 20 are directly connected to the second resonator element 14*b* via the first and second input/output electrodes 28, 30 respectively.

Also in the antenna device 10D according to the fourth embodiment, the first and second resonator elements 14*a*, 14*b*, which are used for the filter section 16, are formed such that both ends are open, in the same manner as in the antenna device 10A according to the first embodiment described above. Therefore, it is unnecessary to form and extend the first and second resonator elements 14*a*, 14*b* up to the end of the dielectric substrate 12. The resonance frequency is not dispersed, for example, even by the variation of the substrate size due to the production process. Therefore, it is possible to provide the high performance antenna device 10D.

The first and second input/output electrodes 28, 30 are provided in the dielectric substrate 12, which are arranged at the positions of linear symmetry with respect to the center in the length direction of at least the second resonator element 14*b* of the first and second resonator elements 14*a*, 14*b*. The first and second input/output electrodes 28, 30 are connected to the first and second input/output terminals 32, 34 of the antenna section 20 respectively. Accordingly, it is possible to appropriately select and perform the balanced input (output) and the unbalanced input (output) for the connection with the antenna section 20. Thus, the connection can be made with the antenna section 20 based on the balanced input/output without using any excessive circuit parts such as the balun.

This contributes to the realization of the small size and the high performance of the antenna device 10D. Consequently, it is possible to reliably realize the small size and the high performance of the electronic instrument (including the communication instrument) provided with the antenna.

This embodiment is also provided with the first to fourth coupling-adjusting electrodes 50, 52, 80, 82. Therefore, it is possible to obtain the filter having a desired band width.

Figure 20:
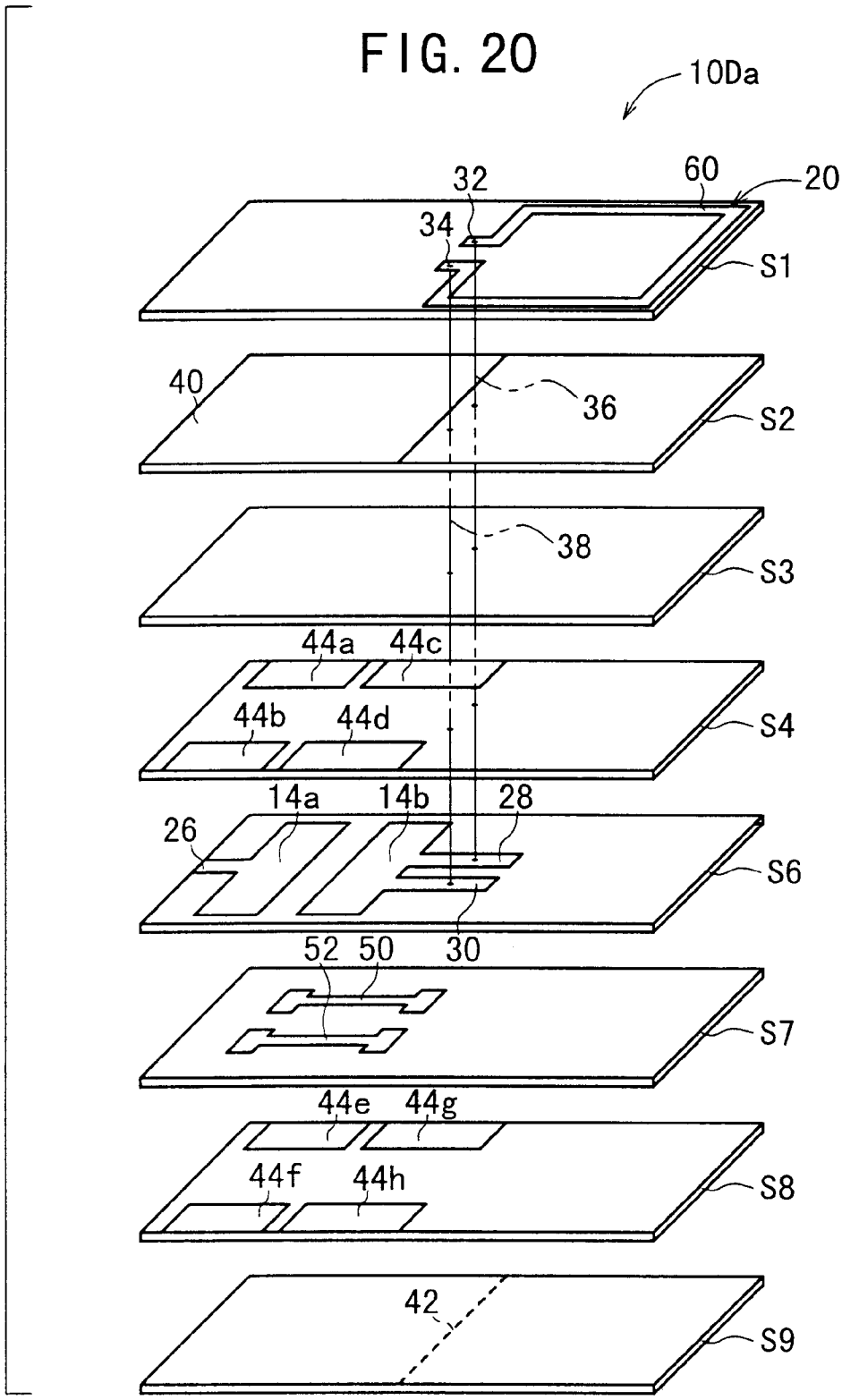
FIG. 20 shows an exploded perspective view illustrating an arrangement of a modified embodiment of the antenna device according to the fourth embodiment.

Of course, it is also allowable to remove the fifth dielectric layer S5 formed with the third and fourth coupling-adjusting electrodes 80, 82, as in an antenna device 10D*a* according to a modified embodiment shown in FIG. 20.

The balanced input antenna such as the dipole antenna and the loop antenna requires the length of ½ wavelength to 1 wavelength, and the shape of the antenna is large, while the size corresponding to ¼ wavelength is sufficient for the monopole or inverse F antenna as widely used, for example, for the portable telephone. As a result, it is feared for the balanced input antenna that the miniaturization of the antenna device 10A is not sufficiently achieved.

Thus, antenna devices 10E to 10G according to fifth to seventh embodiments described below solve the foregoing inconvenience.

At first, an antenna device 10E according to a fifth embodiment will be explained with reference to FIGS. 21 to 22.

Figure 21:
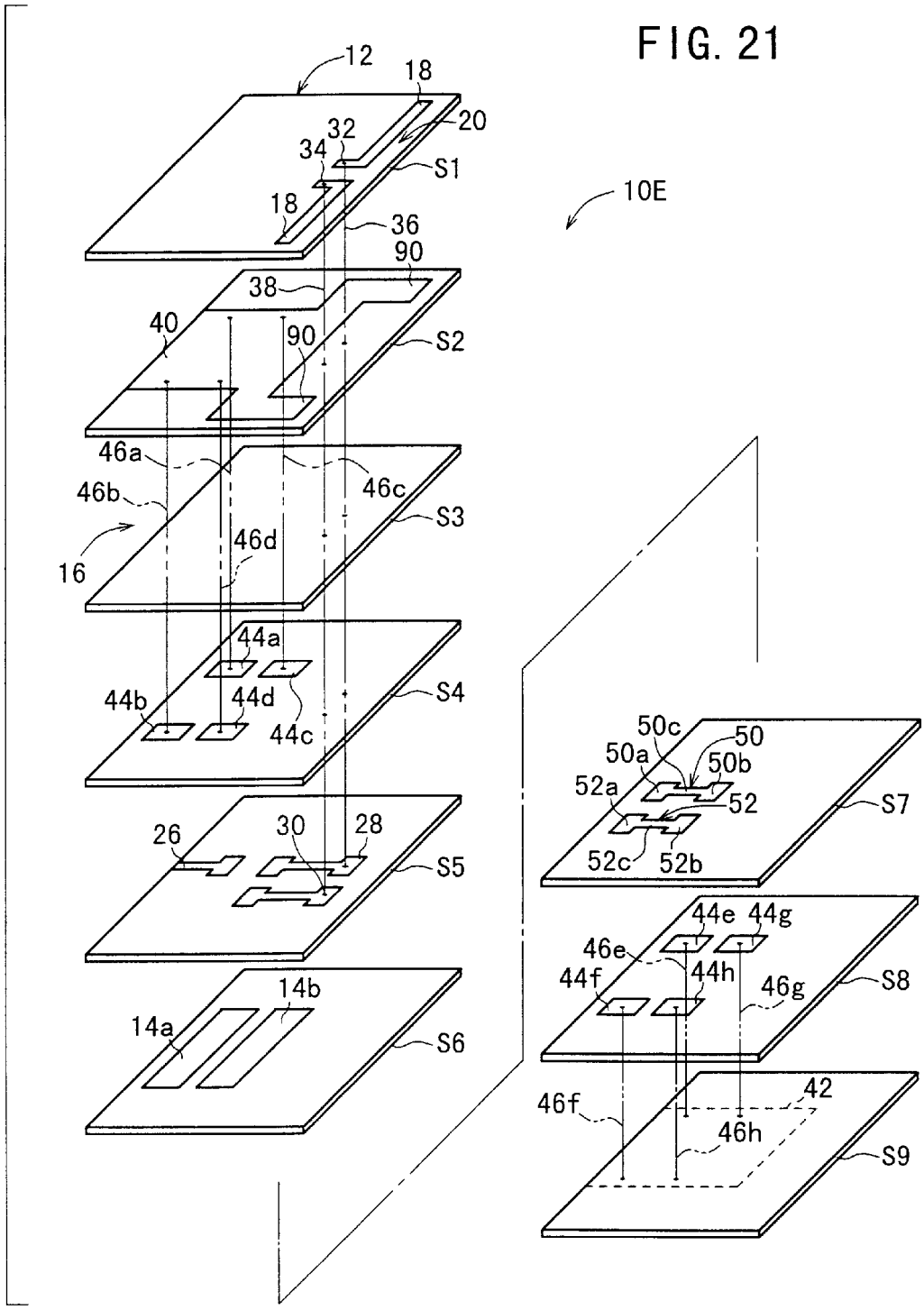
FIG. 21 shows an exploded perspective view illustrating an arrangement of an antenna device according to a fifth embodiment.

As shown in FIG. 21, the antenna device 10E according to the fifth embodiment is constructed in approximately the same manner as the antenna device 10A according to the first embodiment described above. However, the former is different from the latter in the following points. That is, second inner layer ground electrodes 90, which expand from the both sides of the inner layer ground electrode 40 toward the respective open ends of the antennas 18, are formed in an integrated manner. The respective ends of the second inner layer ground electrodes 90 are overlapped with the respective open ends of the antennas 18 with the first dielectric layer S1 interposed therebetween.

Figure 22:
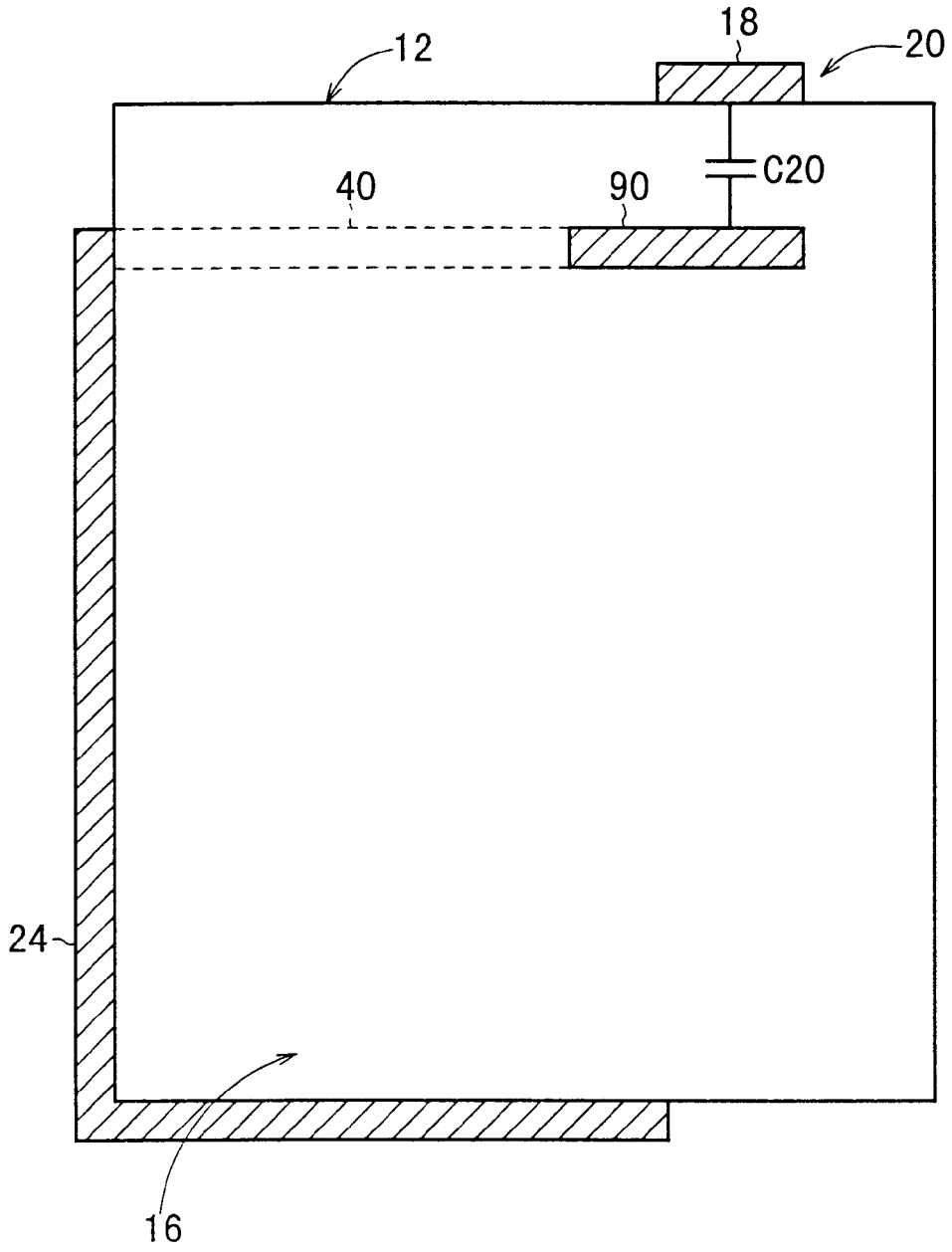
FIG. 22 shows a sectional view illustrating an arrangement obtained by cutting the antenna device according to the fifth embodiment in a direction perpendicular to a portion at which a second inner layer ground electrode and an open end of an antenna are opposed to one another.

Therefore, as shown in FIG. 22, the antenna device 10E has such a form that capacitances C20 are formed between the second inner layer ground electrodes 90 and the open ends of the respective antennas 18 for constructing the antenna section 20 respectively.

The antennas 18 for constructing the antenna section 20 are constructed by strip lines formed on the dielectric substrate 12. The strip lines can be regarded to be equivalent to the resonators 14*a*, 14*b* formed in the filter section 16, and they can be equivalently transformed as the parallel resonance circuit.

Therefore, the capacitance C20, which is formed between the second inner layer ground electrode 90 and each of the open ends of the antennas 18, is added to the capacitance of the parallel resonance circuit obtained by the equivalent transformation of the antennas 18. Therefore, assuming that the resonance frequency is identical, it is enough that the inductance of the parallel resonance circuit is small. As a result, it is possible to further decrease the length of the antenna 18 (antenna length). Thus, it is possible to shorten the entire length of the antenna section 20.

As described above, the fifth embodiment is also advantageous in that the miniaturization of the antenna device 10E can be effectively realized, for example, in addition to the advantages that the number of parts is reduced, and the antenna characteristic is scarcely affected by the casing of the electronic instrument.

Next, an antenna device 10F according to a sixth embodiment will be explained with reference to FIGS. 23 and 24.

Figure 23:
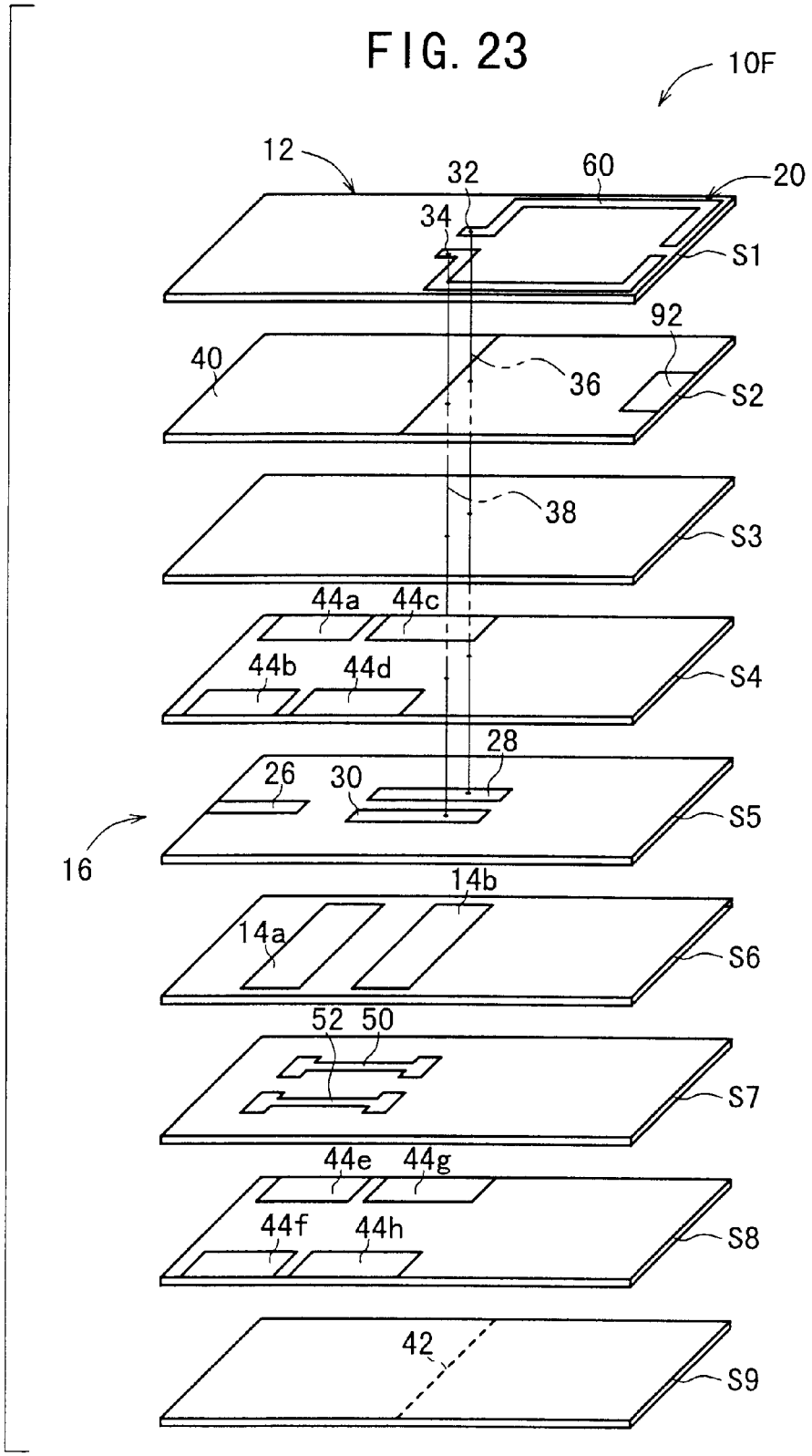
FIG. 23 shows an exploded perspective view illustrating an arrangement of an antenna device according to a sixth embodiment.

As shown in FIG. 23, the antenna device 10F according to the sixth embodiment is constructed in approximately the same manner as the antenna device 10B according to the second embodiment described above (see FIG. 8). However, the former is different from the latter in the following points.

At first, antennas 60, which construct the antenna section 20, are formed on the first dielectric layer S1 so that respective open ends are disposed at close positions. Slight gaps are formed between the respective open ends.

A second inner layer ground electrode 92, which is located at a position corresponding to the respective open ends of the antennas 60, is formed on the second dielectric layer S2, in addition to the inner layer ground electrode 40. Capacitances (not shown) are formed between the respective open ends of the antennas 60 and the second inner layer ground electrode 92.

Figure 24:
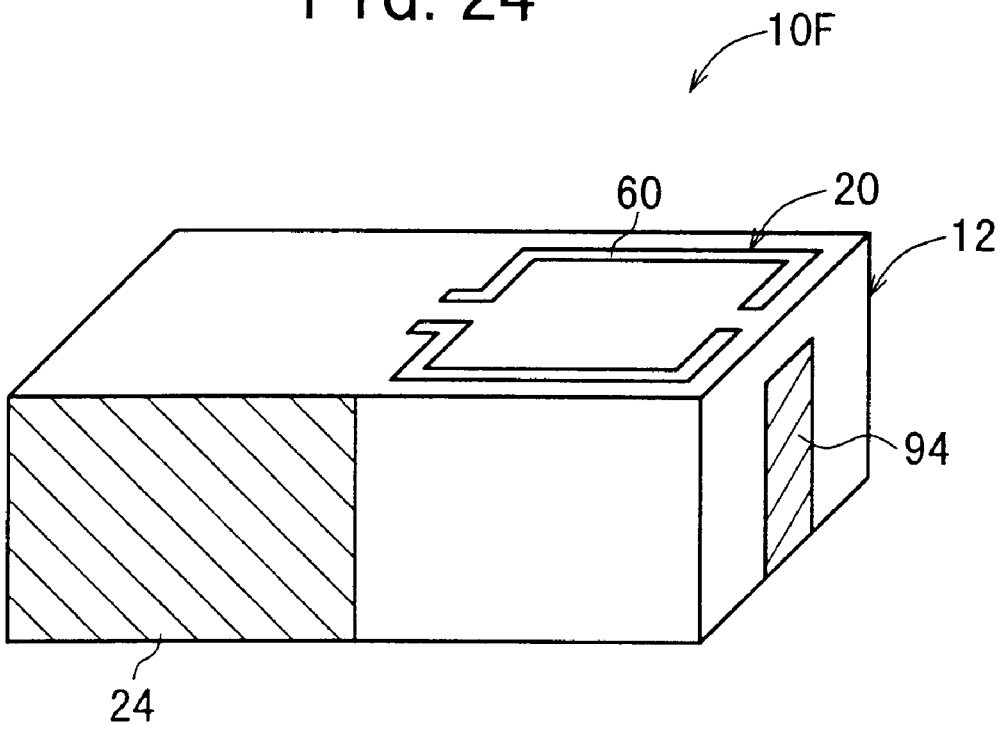
FIG. 24 shows a perspective view illustrating an appearance of the antenna device according to the sixth embodiment.

As shown in FIG. 24, for example, the second inner layer ground electrode 92 is connected to a second ground electrode 94 which is formed at a position (on the right side surface in the example shown in the drawing) different from the ground electrode 24 formed on the surface on the side of the filter section 16 of the dielectric substrate 12.

Also in the sixth embodiment, the capacitances are formed between the respective open ends of the antennas 60 and the second inner layer ground electrode 92 by forming the second inner layer ground electrode 92 at the position corresponding to the respective open ends of the antennas 60. Therefore, the sixth embodiment is also advantageous in that the miniaturization of the antenna device 10F can be effectively realized, for example, in addition to the advantages that the number of parts is reduced, and the antenna characteristic is scarcely affected by the casing of the electronic instrument.

Next, an antenna device 10G according to a seventh embodiment will be explained with reference to FIGS. 25 and 26.

Figure 25:
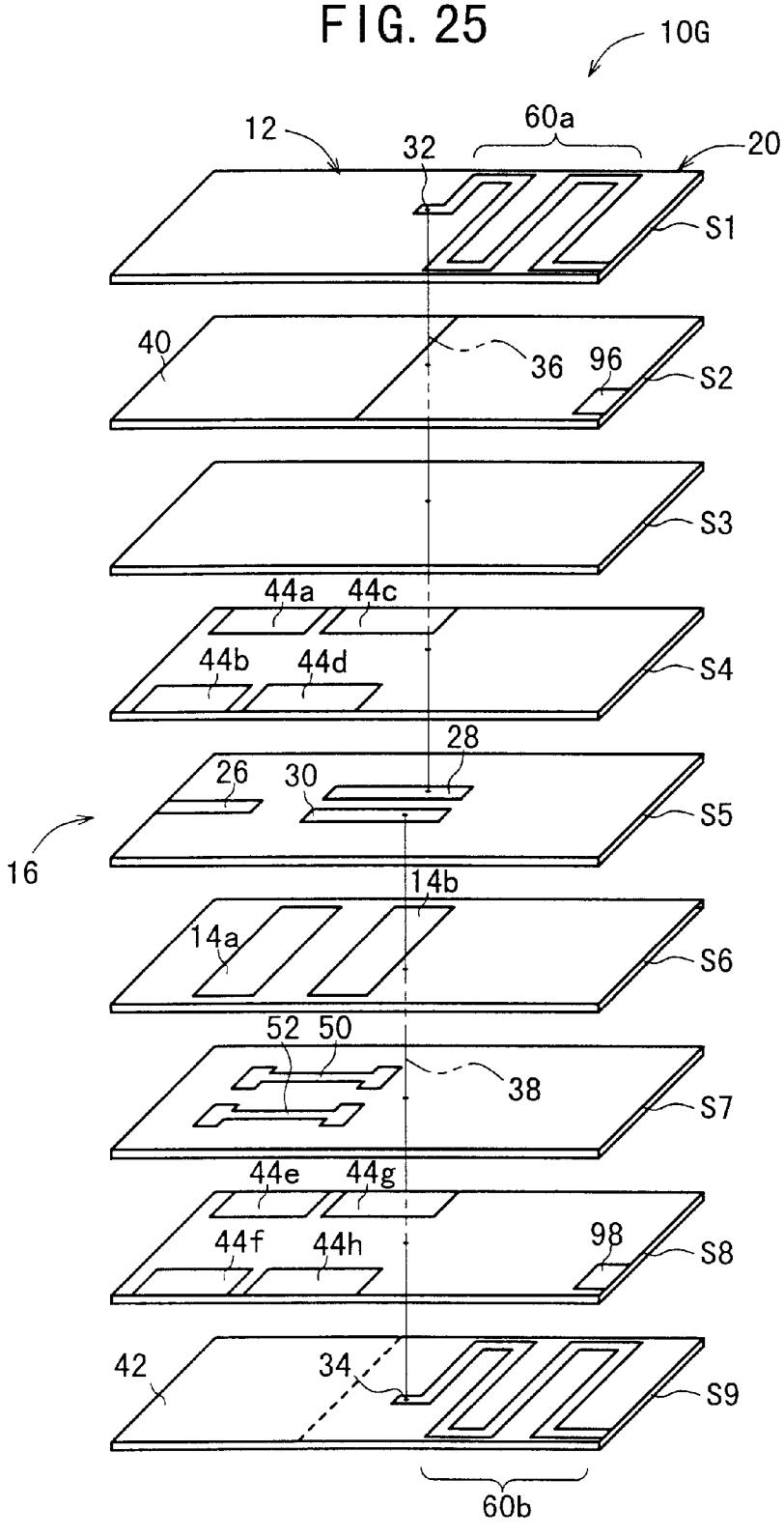
FIG. 25 shows an exploded perspective view illustrating an arrangement of an antenna device according to a seventh embodiment.
Figure 26:
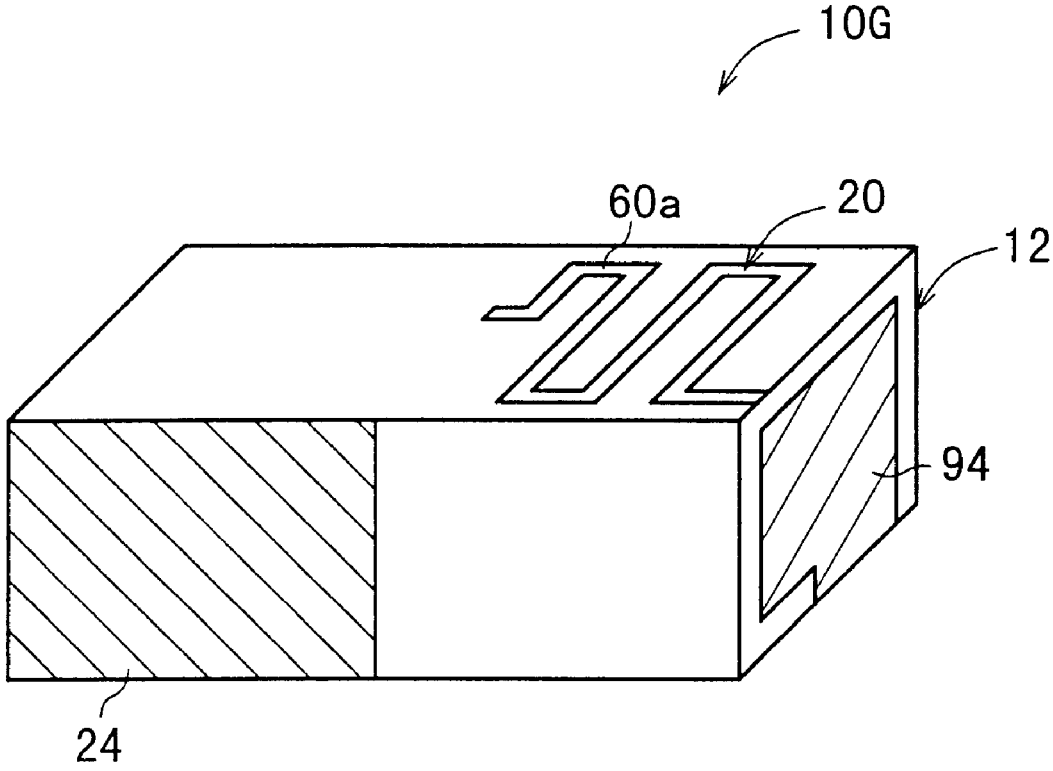
FIG. 26 shows a perspective view illustrating an appearance of the antenna device according to the seventh embodiment.

As shown in FIG. 25, the antenna device 10G according to the seventh embodiment is constructed in approximately the same manner as the first modified embodiment 10B*a* of the antenna device 10B according to the second embodiment (see FIG. 10). However, the former is different from the latter in the following points.

At first, the antenna section 20 comprises a first meandering pattern 60*a* based on an electrode film formed on the first principal surface of the first dielectric layer S1, and a second meandering pattern 60*b* based on an electrode film formed on the first principal surface of the ninth dielectric layer S9.

A second inner layer ground electrode 96 is formed at a position on the second dielectric layer S2 overlapped with an open end of the first meandering pattern 60*a* with the first dielectric layer S1 interposed therebetween. A third inner layer ground electrode 98 is formed at a position on the eighth dielectric layer S8 overlapped with an open end of the second meandering pattern 60*b* with the ninth dielectric layer S9 interposed therebetween. As shown in FIG. 26, for example, the second and third inner layer ground electrodes 96, 98 are connected to a second ground electrode 94 which is formed at a position (on the right side surface in the example shown in the drawing) different from the ground electrode 24 formed on the surface on the side of the filter section 16 of the dielectric substrate 12.

Further, in this embodiment, a second end (first input/output terminal 32) of the first meandering pattern 60*a* is electrically connected with the first input/output electrode 28 via a through-hole 36. A second end (second input/output terminal 34) of the second meandering pattern 60*b* is electrically connected with the second input/output electrode 30 via a through-hole 38.

Also in the seventh embodiment, a capacitance is formed between the second inner layer ground electrode 96 and the open end of the first meandering pattern 60*a* for constructing the antenna section 20. A capacitance is formed between the third inner layer ground electrode 98 and the open end of the second meandering pattern 60*b*. Therefore, the seventh embodiment is also advantageous in that the miniaturization of the antenna device 10G can be effectively realized, for example, in addition to the advantages that the number of parts is reduced, and the antenna characteristic is scarcely affected by the casing of the electronic instrument.

It is a matter of course that the antenna device according to the present invention is not limited to the embodiments described above, which may be embodied in other various forms without deviating from the gist or essential characteristics of the present invention.

As explained above, according to the antenna device concerning the present invention, it is possible to appropriately select and perform the balanced input (output) and the unbalanced input (output) for the connection between the filter section and the antenna section. Thus, it is possible to realize the small size and the high performance of the electronic instrument (including the communication instrument) provided with the antenna.

What is claimed is:

1. An antenna device comprising:

an antenna section comprising an antenna having a balanced input/output including balanced antenna terminals; and a filter section comprising a filter having a balanced input/output portion including filter terminals, wherein said input/output portion is electrically connected to said antenna terminals.

2. The antenna device according to claim 1, further comprising a ground electrode for constructing a capacitance together with an open end of said antenna section.

3. The antenna device according to claim 1, wherein said antenna section and said filter section are integrated into one unit.

4. The antenna device according to claim 3, including:

a dielectric substrate which includes a large number of stacked dielectric layers and which has at least an input/output terminal and a ground electrode formed on its outer circumferential surface, wherein:

said filter section includes a plurality of ½ wavelength resonators of a both ends-open type arranged in parallel to one another in said dielectric substrate respectively; and said antenna section is formed on said dielectric substrate.

5. The antenna device according to claim 4, wherein said antenna section and said filter section are formed in regions which are two-dimensionally separated from each other on said dielectric substrate.

6. The antenna device according to claim 4, wherein:

said filter terminals include two input/output electrodes, which are arranged at positions of linear symmetry with respect to a center in a length direction of said ½ wavelength resonator disposed on a side of said antenna section, of said plurality of ½ wavelength resonators, and are provided in said dielectric substrate; and said two input/output electrodes are connected to said balanced terminals of said antenna section.

7. The antenna device according to claim 6, wherein said two input/output electrodes are capacitively coupled to said ½ wavelength resonator disposed on said side of said antenna section respectively.

8. The antenna device according to claim 6, wherein said two input/output electrodes are directly connected to said ½ wavelength resonator disposed on said side of said antenna section respectively.

9. The antenna device according to claim 4, wherein said filter section includes a coupling-adjusting electrode which is overlapped with said adjoining ½ wavelength resonators with said dielectric layer interposed therebetween in said dielectric substrate and which effects capacitive coupling for said adjoining ½ wavelength resonators.

10. The antenna device according to claim 9, wherein:

a plurality of coupling-adjusting electrodes as defined above are formed; and said plurality of coupling-adjusting electrodes are formed at positions of linear symmetry with respect to a center in a length direction of said ½ wavelength resonator.

11. The antenna device according to claim 4, wherein said filter section includes inner layer ground electrodes which are arranged to overlap both open ends of each of said ½ wavelength resonators with said dielectric layer interposed therebetween.

12. The antenna device according to claim 4, wherein said dielectric substrate is formed such that a dielectric constant of said dielectric layer on which said antenna section is formed is different from a dielectric constant of said dielectric layer on which said filter section is formed.

13. The antenna device according to claim 12, wherein said dielectric constant of said dielectric layer on which said antenna section is formed is lower than said dielectric constant of said dielectric layer on which said filter section is formed.

* * * * *